US010180644B2

(12) United States Patent
Tsubotani et al.

(10) Patent No.: US 10,180,644 B2
(45) Date of Patent: Jan. 15, 2019

(54) FIXING DEVICE HAVING AN ENDLESS BELT AND GUIDE MEMBER AND IMAGE FORMING APPARATUS

(71) Applicant: KONICA MINOLTA, INC., Chiyoda-ku, Tokyo (JP)

(72) Inventors: Yoshikazu Tsubotani, Toyokawa (JP); Naoki Yamamoto, Toyohashi (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/644,701

(22) Filed: Jul. 7, 2017

(65) Prior Publication Data

US 2018/0011435 A1 Jan. 11, 2018

(30) Foreign Application Priority Data

Jul. 8, 2016 (JP) ..... 2016-136075
Sep. 21, 2016 (JP) ..... 2016-184132

(51) Int. Cl.
*G03G 15/20* (2006.01)

(52) U.S. Cl.
CPC ..... *G03G 15/2028* (2013.01); *G03G 15/2053* (2013.01); *G03G 15/2025* (2013.01); *G03G 2215/2038* (2013.01)

(58) Field of Classification Search
CPC ..... G03G 15/2075; G03G 15/2085
See application file for complete search history.

(56) References Cited

U.S. PATENT DOCUMENTS 6,456,819 B1 * 9/2002 Abe ..... G03G 15/2064 219/216
8,655,246 B2 * 2/2014 Tokuda ..... G03G 15/2039 399/329
8,725,050 B2 * 5/2014 Ohtsu ..... G03G 15/2053 399/329
2010/0209151 A1 * 8/2010 Nishinoue ..... G03G 15/2053 399/329

(Continued)

FOREIGN PATENT DOCUMENTS

JP 2003-337481 A 11/2003
JP 2008-046663 A 2/2008

(Continued)

*Primary Examiner* — G. M. A Hyder

(74) *Attorney, Agent, or Firm* — Buchanan Ingersoll & Rooney PC

(57) ABSTRACT

A fixing device includes: a fixing belt of an endless shape wound to pass over a heating-side member and a nip forming member; and a pressing roller driven to rotate in a state of being brought into tight contact with the nip forming member through the fixing belt, wherein a toner image is fixed to a recording medium at a nip portion at which the fixing belt and the pressing roller are brought into tight contact with each other by causing the pressing roller to be in tight contact with the fixing belt and driving the pressing roller to rotate, a guide member guiding the fixing belt to a space between the nip forming member and the heating-side member is disposed to be separate from the nip forming member, and a sliding member is disposed at least in a contact portion between the nip forming member and the fixing belt.

8 Claims, 15 Drawing Sheets

(56) References Cited

U.S. PATENT DOCUMENTS

| | | | | |
|---|---|---|---|---|
| 2013/0243501 | A1* | 9/2013 | Chiba | G03G 15/2028 399/329 |
| 2017/0364006 | A1* | 12/2017 | Minemura | G03G 15/2053 |
| 2018/0081310 | A1* | 3/2018 | Tsubotani | G03G 15/2025 |

FOREIGN PATENT DOCUMENTS

| | | | |
|---|---|---|---|
| JP | 2008-064923 | A | 3/2008 |
| JP | 2016-095326 | A | 5/2016 |

* cited by examiner

FIXING DEVICE HAVING AN ENDLESS BELT AND GUIDE MEMBER AND IMAGE FORMING APPARATUS

Japanese Patent Application No. 2016-136075 filed on Jul. 8, 2016 and No. 2016-184132 filed on Sep. 21, 2016, including description, claims, drawings, and abstract the entire disclosures are incorporated herein by reference in its entirety.

BACKGROUND

Technological Field

The present invention relates to an image forming apparatus such as a copying machine, a printer, a facsimile, and a multi-function apparatus thereof and a fixing device that fixes a toner image formed on a recording medium to the recording medium in such an image forming apparatus. Particularly, in a fixing device including an endless fixing belt that is wound to pass over a heating-side member and a nip forming member and a pressing roller that is driven to rotate in the state of being brought into tight contact with the nip forming member through the fixing belt and fixing a toner image to a recording medium in a nip portion at which the fixing belt and the pressing roller are brought into tight contact with each other by causing the pressing roller to be in tight contact with the fixing belt and driving the pressing roller to rotate, there is a feature in that the fixing belt is stably rotated in the state of being in tight contact with the nip forming member by decreasing frictional resistance between the fixing belt and the nip forming member by employing a simple configuration.

Description of the Related Art

Generally, in an image forming apparatus such as a copying machine, a printer, a facsimile, or a multi-function apparatus thereof, a toner image transferred onto a recording medium is fixed onto the recording medium by using a fixing device.

In such a fixing device, in fixing a toner image transferred to a recording medium to a sheet by using heat and pressure, in order to save energy, an endless fixing belt is wound to pass over a heating roller and a heating-side roller, the pressing roller is driven to rotate in the state of being in tight contact with the heating-side roller through the fixing belt, and the toner image is fixed to a recording medium at a nip portion at which the fixing belt and the pressing roller are tightly brought into contact with each other.

In addition, in recent years, in order to further save energy, for example, as disclosed in JP 2008-46663 A, it is proposed that, instead of the heating-side roller described above, by using a fixing member, in which a heat-resistant elastic member is disposed at a portion at which a nip is formed by causing the pressing roller to be in tight contact therein, that does not rotate, the fixing belt described above is wound to pass over a heating roller and the fixing member, and, by causing the pressing roller that is driven to rotate to be in tight contact with the heat-resistant elastic member through the fixing belt, the fixing belt is driven to rotate together with the pressing roller, and, in a nip portion at which the fixing belt and the pressing roller are brought into tight contact with each other, a toner image is fixed to a recording medium.

However, in the technology disclosed in JP 2008-46663 A, sliding resistance is generated according to friction between the heat-resistant elastic member of the fixing member and the fixing belt, and the rotation of the fixing belt becomes unstable, whereby there is a problem of the presence of an adverse effect on a formed image and the like.

In addition, as disclosed in JP 2003-337481 A, a fixing device fixing an unfixed image on a recording material is known. When devices configuring an image forming apparatus are compared with each other, the power consumption of the fixing device is relatively high. In order to decrease the power consumption of the image forming apparatus, it is effective to decrease the power consumption of the fixing device.

The fixing device fixes an unfixed image through pressurization and heating. As one of techniques for decreasing the power consumption of the fixing device, it is considered to lower the fixing temperature. In a case where the fixing temperature is set to be low, in order to suppress the degradation of the image quality (fixing quality), it is necessary to employ some countermeasure.

For example, in a case where same toner is used, by increasing the load at the fixing nip or increasing a nip time, the influence according to the lowering of the fixing temperature can be decreased. Also in a case where the fixing temperature is lowered, by employing such a countermeasure, degradation of the fixing quality can be suppressed, and furthermore, the power consumption of the fixing device can be decreased.

SUMMARY

An object of the present invention is to solve the problem described above in a fixing device fixing a toner image transferred to a recording medium on the recording medium in an image forming apparatus such as a copying machine, a printer, a facsimile, or a multi-function apparatus thereof.

In one embodiment of the present invention, in a fixing device including an endless fixing belt that is wound to pass over a heating-side member and a nip forming member and a pressing roller that is driven to rotate in the state of being brought into tight contact with the nip forming member through the fixing belt and fixing a toner image to a recording medium in a nip portion at which the fixing belt and the pressing roller are brought into tight contact with each other by causing the pressing roller to be in tight contact with the fixing belt and driving the pressing roller to rotate, an object is to enable stably performing of appropriate image formation by stably rotating the fixing belt in the state of being brought into tight contact with the nip forming member by decreasing frictional resistance between the fixing belt and the nip forming member through a simple configuration.

In addition, in a case where the load is high at the fixing nip, there are cases where an increase in a bending load or friction acting on each unit of the fixing device is caused, and there is concern that the wear of the shaft progresses, or driving torque increases. In order to lengthen the nip time, for example, the diameter of the pressing member needs to be increased. Thus, there is concern that the size of the device is increased, or the durability life of the pressing member is shortened due to a decrease in the surface hardness of the pressing member.

The inventors and the like of the present invention found a technique of forming a pressure distribution in which the contact pressure of a part in the circumferential direction inside the fixing nip is locally increased inside the fixing nip. In a case where such a technique is employed, the influence of the lowering of the fixing temperature can be decreased, and furthermore, the power consumption of the fixing device can be decreased. In addition, the inventors and the like of the present invention found that, in a case where a portion in which the contact pressure is locally increased is arranged in a downstream end portion or an upstream end portion in the circumferential direction inside the fixing nip, there is a room for new improvement.

Another embodiment of the present invention is devised in consideration of the situations described above, and an object thereof is to provide a fixing device and an image forming apparatus including the fixing device.

To achieve at least one of the abovementioned objects, according to an aspect of the present invention, a fixing device reflecting one aspect of the present invention comprises: a fixing belt of an endless shape that is wound to pass over a heating-side member and a nip forming member; and a pressing roller that is driven to rotate in a state of being brought into tight contact with the nip forming member through the fixing belt, wherein a toner image is fixed to a recording medium at a nip portion at which the fixing belt and the pressing roller are brought into tight contact with each other by causing the pressing roller to be in tight contact with the fixing belt and driving the pressing roller to rotate, a guide member guiding the fixing belt to a space between the nip forming member and the heating-side member is disposed to be separate from the nip forming member, and a sliding member is disposed at least in a contact portion between the nip forming member and the fixing belt.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
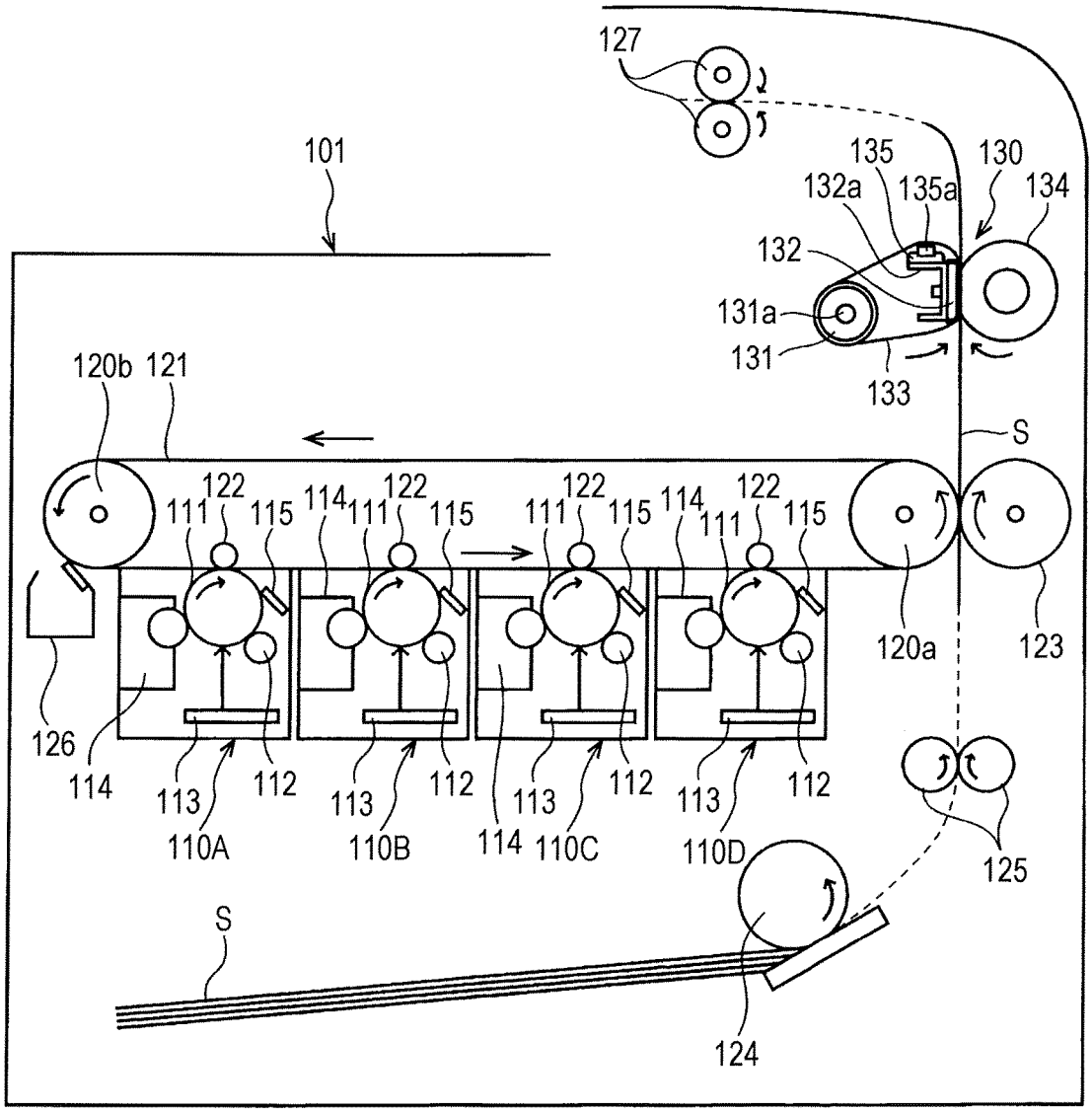
FIG. 1 is a schematic explanatory diagram that illustrates an example of an image forming apparatus using a fixing device according to a first embodiment of the present invention.

Hereinafter, one or more embodiments of the present invention will be described with reference to the drawings. However, the scope of the invention is not limited to the disclosed embodiments. In the following description, a same reference numeral will be assigned to same components or components corresponding to each other, and duplicate description may not be repeated.

[First Embodiment]

First, a fixing device according to the first embodiment of the present invention and an image forming apparatus using this fixing device will be described specifically with reference to the attached drawings. However, a fixing device and an image forming apparatus according to the present invention are not limited to those illustrated in the following embodiments but may be appropriately changed in a range not changing the concept thereof.

The image forming apparatus 101 according to this the first embodiment, as illustrated in FIG. 1, has four imaging cartridges 110A to 110D mounted on the inside thereof.

Here, in each of the imaging cartridges 110A to 110D described above, a photosensitive body 111, a charging device 112 that charges the surface of the photosensitive body 111, a latent image forming device 113 that forms an electrostatic latent image on the surface of the photosensitive body 111 by performing exposure corresponding to image information for the surface of the charged photosensitive body 111, a developing device 114 that forms a toner image by supplying toner for the electrostatic latent image formed on the surface of the photosensitive body 111, and a first cleaning device 115 that removes toner remaining after the transfer of the toner image formed on the surface of the photosensitive body 111 onto an intermediate transfer belt 121 from the surface of the photosensitive body 111 are arranged.

In addition, in the developing devices 114 of the imaging cartridges 110A to 110D described above, toners of mutually-different colors are housed, and toners of black, yellow, magenta, and cyan are housed therein.

In each of the imaging cartridges 110A to 110D of this image forming apparatus 101, the surface of the photosensitive body 111 is electrically charged by the charging device 112, for the surface of the photosensitive body 111 charged in this way, exposure corresponding to image information is performed by the latent image forming device 113, an electrostatic latent image corresponding to image information is formed on the surface of the photosensitive body 111, and toner of a respective color is supplied from the developing device 114 described above for the electrostatic latent image formed on the surface of the photosensitive body 111, whereby a toner image of the respective color is formed on the surface of the photosensitive body 111.

Thereafter, by sequentially transferring toner images of the colors formed on the surfaces of the photosensitive bodies 111 of the imaging cartridges 110A to 110D in this way onto the intermediate transfer belt 121 that is wound to pass over a drive roller 120*a* and a rotation roller 120*b* by using the primary transfer roller 122 and is driven to rotate, a toner image composed on the intermediate transfer belt 121 is formed, the toner image formed in this way is guided to a position facing a secondary transfer roller 123 by the intermediate transfer belt 121, and toner remaining on the surfaces of the photosensitive bodies 111 after the transfer is removed from the surfaces of the photosensitive bodies 111 by corresponding first cleaning devices 115.

Meanwhile, a recording medium S housed inside this image forming apparatus 101 is fed by a sheet feed roller 124 and is guided to a timing roller 125. Then, the recording medium S is guided by the timing roller 125 to a space between the intermediate transfer belt 121 described above and the secondary transfer roller 123 at appropriate timing.

Then, the above-described toner image formed on the intermediate transfer belt 121 is transferred to this recording medium S by the secondary transfer roller 123, and toner that is not transferred to the recording medium S but remains on the intermediate transfer belt 121 is removed from the intermediate transfer belt 121 by a second cleaning device 126.

Thereafter, after the recording medium S to which the toner image has been transferred in this way is guided to a fixing device 130, and the unfixed toner image that has been transferred to the recording medium S is fixed to the recording medium S by the fixing device 130, the recording medium S to which the toner image is fixed is separated from the fixing device 130 and is guided to a sheet discharge roller 127, and the recording medium S to which the toner image has been fixed is discharged by this sheet discharge roller 127.

Figure 2:
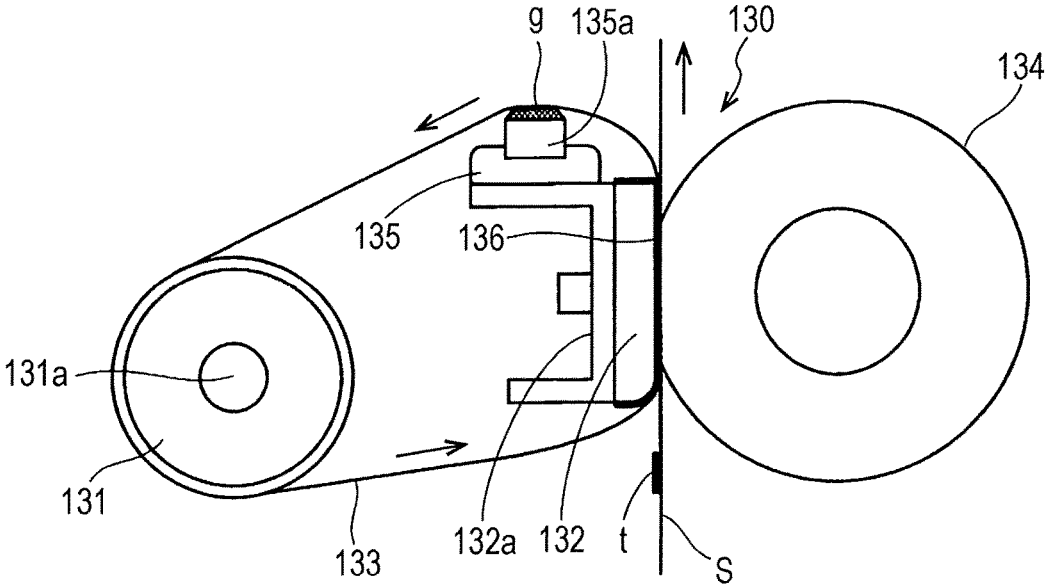
FIG. 2 is a schematic explanatory diagram that illustrates the fixing device according to the first embodiment.

Then, in the fixing device 130 according to this the first embodiment, as illustrated in FIGS. 1 and 2, by using a heating roller 131 having a heater 131*a* such as a halogen lamp disposed therein as a heating-side member 131, the fixing belt 133 is heated by this heating roller 131. The heating-side member 131 is not limited thereto but, although not illustrated in the drawing, a member of a system heating the fixing belt 133 through induction heating (IH) or a member of a system heating the fixing belt 133 using a resistance heating element or the like may be used.

Here, in the fixing device 130 according to this the first embodiment, as the fixing belt 133 described above, for example, a belt including a base layer, an elastic layer, and a releasing layer is used, and although the outer diameter thereof is arbitrary, generally, a belt having an outer diameter of about 10 to 100 mm is used. As the base layer described above, for example, a layer composed using polyimide, SUS, Ni electroforming, or the like and having a thickness of 5 to 100 μm may be used. In addition, as the elastic layer, for example, a layer composed using a material having a high heat resisting property such as silicon rubber or fluororubber is preferably used, and a layer having a thickness of about 10 to 300 μm may be used. As the releasing layer, for example, a layer of a configuration to which a releasing property is given such as a fluorine tube or fluorine-based coating may be preferably used, and a layer having a thickness of about 5 to 100 μm may be used.

Then, the fixing belt 133 described above is wound to pass over the heating roller 131 described above and a nip forming member 132 that is fixed to a fixing member 132*a* formed in a groove shape so as to be held therein, a pressing roller 134 that is driven to rotate is brought into tight contact with the nip forming member 132 described above with the fixing belt 133 disposed therebetween, tension is applied to the fixing belt 133 described above by using a biasing unit (not illustrated in the drawing), in this state, the fixing belt 133 is rotated together with the pressing roller 134, and, at a nip portion at which the heated fixing belt 133 is brought into tight contact with the pressing roller 134 by the nip forming member 132 described above, a toner image t is fixed to a recording medium S.

Here, as the material of the nip forming member 132 described above, for example, a resin such as polyphenylene sulfide, polyimide, or a liquid crystal polymer, a metal such aluminum or iron, ceramics, or the like may be used.

As the pressing roller 134 described above, for example, a roller in which an elastic layer and a releasing layer are disposed on the outer circumference of a core may be used. In addition, although the outer diameter of the pressing roller 134 is not particularly limited, the diameter may be about 20 to 100 mm. Here, the core described above, for example, is preferably configured by a metal such as aluminum or iron and may have a pipe shape of a thickness of 0.1 to 10 mm or a solid shape or may have a releasing mold of which the cross-sectional shape is hollow. In addition, as the releasing layer described above, for example, a releasing layer to which a releasing property is given using a fluorine tube, fluorine-based coating, or the like may be preferably used, and, generally, a releasing layer having a thickness of 5 to 100 μm may be used.

Figure 3:
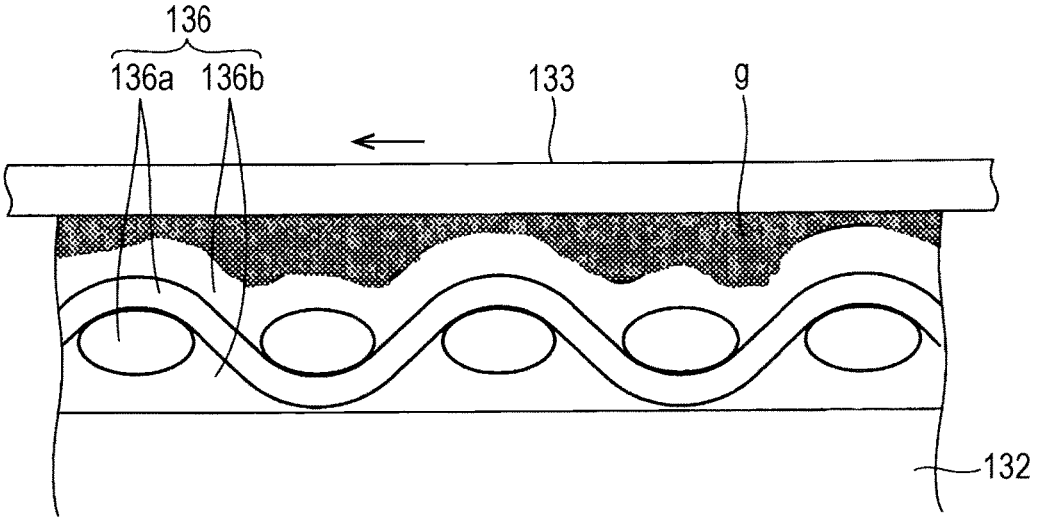
FIG. 3 is a partial cross-sectional explanatory diagram that illustrates a state in which a sliding member is arranged at a contact portion between a nip forming member and a fixing belt in the fixing device according to the first embodiment.

In addition, in the fixing device 130 according to this the first embodiment, as illustrated in FIGS. 2 and 3, the sliding member 136 is disposed to include at least a contact portion between the nip forming member 132 and the fixing belt 133.

Here, as the sliding member 136 described above, in this the first embodiment, as illustrated in FIG. 3, a fluorine-based resin 136*b* is disposed to cover a sheet member 136*a* composed by glass fibers, and, on the face of the sliding member 136 that is disposed on the fixing belt 133 side, unevenness is formed, and, in this uneven portion, for example, a lubricant g using fluorine-based grease having viscosity and a superior heat resisting property is held.

In this way, it is suppressed for heat transmitted from the fixing belt 133 to run away from the fixing belt 133 to the nip forming member 132 by using the sliding member 136 described above, the heat-resistant temperature of the nip forming member 132 can be raised, and an increase in the driving torque can be suppressed by decreasing contact resistance between the fixing belt 133 and the nip forming member 132, and, the inner circumferential surface of the fixing belt 133 can be simply coated with the lubricant g.

Here, while the size of the unevenness formed on the face of the sliding member 136 that is disposed on the fixing belt 133 side is not particularly limited, it is preferable to configure the surface roughness Ra of the sliding member 136 to be in the range of 1 to 50 μm from the viewpoint of the function for holding the lubricant g in the uneven portion and suppression of image unevenness due to the unevenness of the sliding member 136.

In addition, in the fixing device 130 according to this the first embodiment, as illustrated in FIGS. 1 and 2, on the downstream side in the moving direction of the fixing belt 133 from a position at which the nip forming member 132 described above and the pressing roller 134 are brought into tight contact with each other, on the fixing member 132*a* that is disposed on the heating roller 131 side from the nip forming member 132 described above, the guide member 135 guiding the fixing belt 133 to a space between the nip forming member 132 and the heating roller 131 is disposed to be separate from the nip forming member 132, a lubricant holding part 135*a* holding the lubricant g using fluorine-based grease having viscosity and a superior heat resisting property or the like is disposed to protrude toward the fixing belt 133 in the guide member 135, and the lubricant holding part 135*a* is brought into contact with the inner circumferential surface of the fixing belt 133.

Here, in a case where the lubricant holding part 135*a* is disposed to be in contact with the inner circumferential surface of the fixing belt 133, a part of the lubricant g, with which the inner circumferential surface of the fixing belt 133 is coated, held in the uneven portion of the sliding member 136 described above is temporarily held in the lubricant holding part 135*a*, or the inner circumferential surface of the fixing belt 133 is coated with a part of the lubricant g held in the lubricant holding part 135*a* in this way from the lubricant holding part 135*a*, and the inner circumferential surface of the fixing belt 133 can be stably coated with the lubricant g.

In addition, as described above, in a case where the lubricant holding part 135*a* is disposed to protrude from the guide member 135 toward the fixing belt 133, only the lubricant holding part 135*a* is brought into contact with the inner circumferential surface of the fixing belt 133, and the fixing belt 133 is configured not to be brought into contact with the other portion of the guide member 135, a contact area between the fixing belt 133 and the guide member 135 is decreased, and the sliding resistance of the fixing belt 133 can be decreased, and the fixing belt 133 is appropriately prevented from being deprived of heat for the guide member 135.

In addition, in the first embodiment described above, while the lubricant holding part 35*a* is disposed to protrude from the guide member 35 toward the fixing belt 33, and only the lubricant holding part 35*a* is brought into contact with the inner circumferential surface of the fixing belt 33, it may be configured such that the lubricant holding part 35*a* is disposed along the surface of the guide member 35, and the fixing belt 33 is brought into contact with the guide member 35 and the lubricant holding part 35*a*.

As the material of the lubricant holding part 135*a* described above, a material having a superior function for holding the lubricant g is preferably used, and, for example, a fibrous member having a high heat resisting property such as an aramid fiber or a fluorine fiber or a porous member having a superior heat resisting property such as silicon sponge is preferably used.

In addition, in the fixing device 130 according to the first embodiment described above, the guide member 135 guiding the fixing belt 133 to a space between the nip forming member 132 and the heating roller 131 is disposed only on the fixing member 132*a* disposed on a further heating roller 131 side than the nip forming member 132 described above on a further downstream side in the moving direction of the fixing belt 133 than the position at which the nip forming member 132 and the pressing roller 134 are brought into tight contact with each other, but the position at which the guide member 135 guiding the fixing belt 133 to a space between the nip forming member 132 and the heating roller 131 is disposed is not limited thereto.

Figure 4:
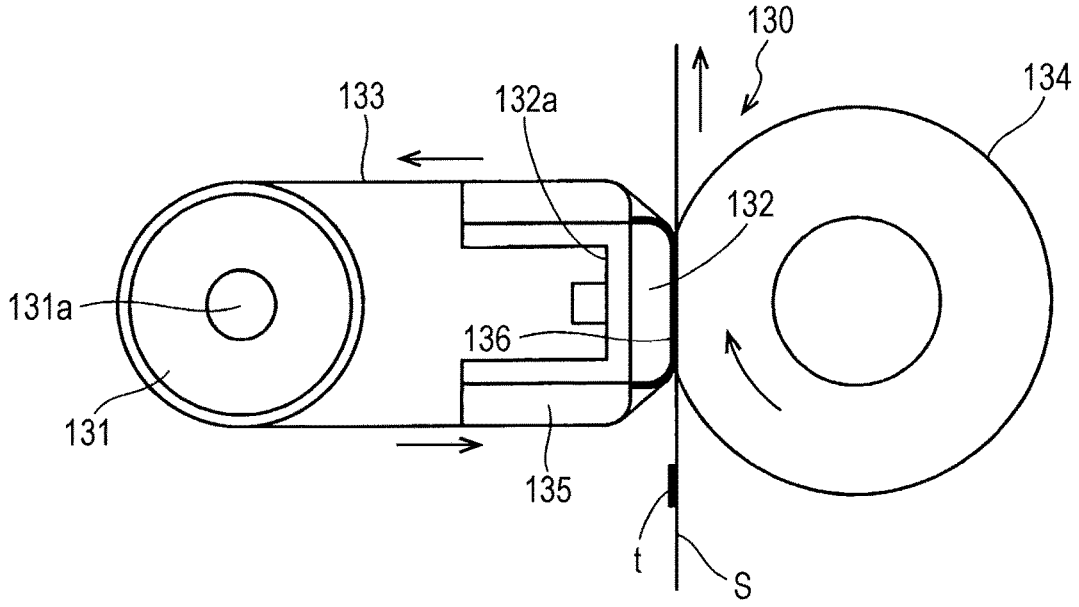
FIG. 4 is a schematic explanatory diagram that illustrates a first modified example of the fixing device according to the first embodiment.
Figure 5:
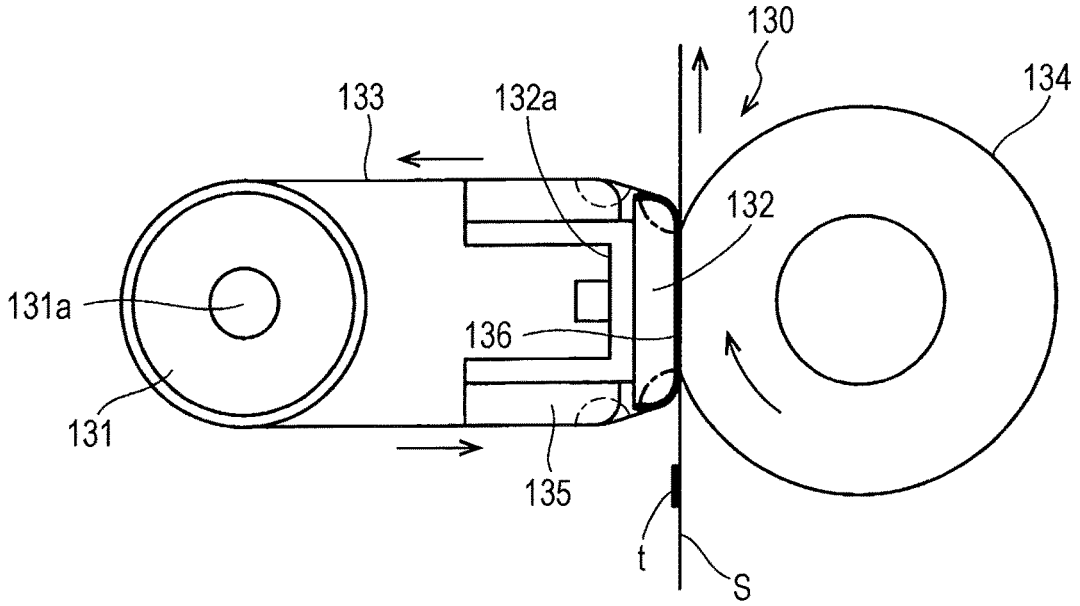
FIG. 5 is a schematic explanatory diagram that illustrates a second modified example of the fixing device according to the first embodiment.
Figure 6:
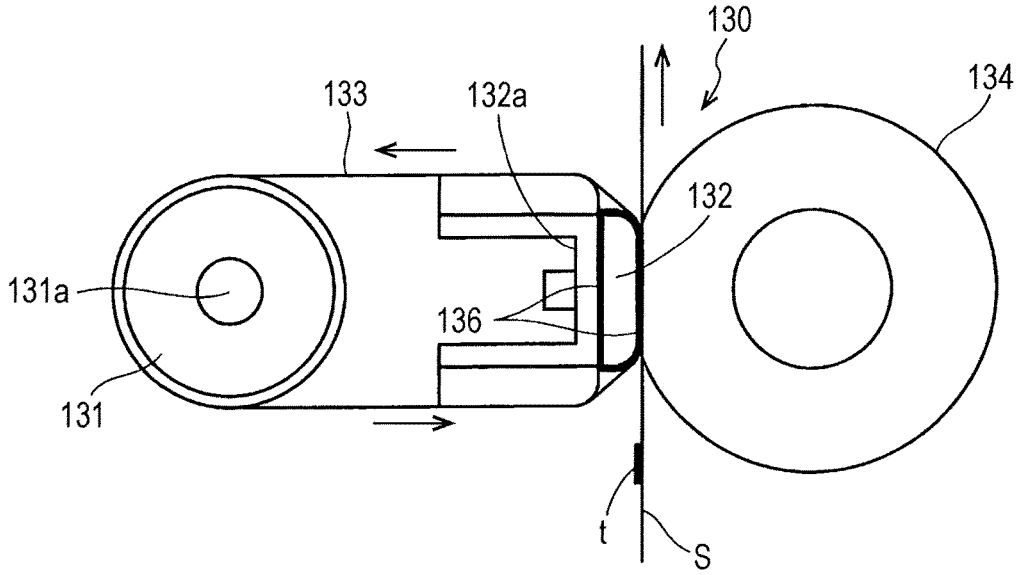
FIG. 6 is a schematic explanatory diagram that illustrates a third modified example of the fixing device according to the first embodiment.

For example, as in first to third modified examples illustrated in FIGS. 4 to 6, the guide member 135 described above may be disposed at positions of both sides of a further upstream side and a further downstream side in the moving direction of the fixing belt 133 than the position at which the nip forming member 132 and the pressing roller 134 are brought into tight contact with each other.

Here, in the first modified example illustrated in FIG. 4, the guide member 135 guiding the fixing belt 133 to a space between the nip forming member 132 and the heating roller 131 is divided into guide members 135 by the nip forming member 132, and the guide members 135 are respectively disposed on the fixing member 132*a* disposed on a further downstream side in the moving direction of the fixing belt 133 than the position at which the nip forming member 132 described above and the pressing roller 134 are brought into tight contact with each other and under the fixing member 132*a* disposed on a further upstream side in the moving direction of the fixing belt 133 than the position at which the nip forming member 132 and the pressing roller 134 are brought into tight contact with each other, and the corner of each guide member 135 facing the nip forming member 132 is formed in an R shape.

In this way, by forming the corner of each guide member 135 facing the nip forming member 132 in the R shape, resistance acquired when the fixing belt 133 moves between the nip forming member 132 and the guide member 135 is decreased, and the fixing belt 133 is stably rotated.

In addition, also in the second modified example illustrated in FIG. 5, similarly to the first modified example illustrated in FIG. 4, the guide member 135 guiding the fixing belt 133 to a space between the nip forming member 132 and the heating roller 131 is divided into guide members 135 by the nip forming member 132, and the guide members 135 are respectively disposed on the fixing member 132*a* disposed on a further downstream side in the moving direction of the fixing belt 133 than the position at which the nip forming member 132 described above and the pressing roller 134 are brought into tight contact with each other and under the fixing member 132*a* disposed on a further upstream side in the moving direction of the fixing belt 133 than the position at which the nip forming member 132 and the pressing roller 134 are brought into tight contact with each other, and the corner of each guide member 135 facing the nip forming member 132 is formed in an R shape.

Then, in the second modified example illustrated in FIG. 5, the nip forming member 132 described above is configured to protrude in the vertical direction of the fixing member 132*a*, each guide member 135 is configured not to be brought into contact with the nip forming member 132, and the curvature of the fixing belt 133 at each vertical end portion of the nip forming member 132 is configured to be larger than the curvature of the fixing belt 133 at a portion of each guide member 135 facing the nip forming member 132.

In this way, by configuring the curvature of the fixing belt 133 at each vertical end portion of the nip forming member 132 in which the sliding member 136 is arranged to be large, the sliding resistance of the fixing belt 133 can be decreased to be smaller than that of a case where the curvature of the fixing belt 133 at a portion of each guide member 135 facing the nip forming member 132 in which the sliding member 136 is not arranged, and a rotation defect in the fixing belt 133 can be prevented.

In addition, also in the third modified example illustrated in FIG. 6, similarly to the first modified example illustrated in FIG. 4, the guide member 135 guiding the fixing belt 133 to a space between the nip forming member 132 and the heating roller 131 is divided into guide members 135 by the nip forming member 132, and the guide members 135 are respectively disposed on the fixing member 132*a* disposed on a further downstream side in the moving direction of the fixing belt 133 than the position at which the nip forming member 132 described above and the pressing roller 134 are brought into tight contact with each other and under the fixing member 132*a* disposed on a further upstream side in the moving direction of the fixing belt 133 than the position at which the nip forming member 132 and the pressing roller 134 are brought into tight contact with each other, and the corner of each guide member 135 facing the nip forming member 132 is formed in an R shape.

In the third modified example illustrated in FIG. 6, the sliding member 136 described above is attached to be wound around the nip forming member 132.

In this way, by attaching the sliding member 136 to be wound around the nip forming member 132, when the fixing belt 133 is rotated with the pressing roller 134 brought into tight contact with the nip forming member 132, the sliding member 136, while the fixing belt 133 and the nip forming member 132 are brought into contact with each other, neither deviates from a portion at which the fixing belt 133 and the nip forming member 132 are brought into contact with each other nor is striped from the contact between the fixing belt 133 and the nip forming member 132, and the sliding resistance of the fixing belt 133 can be stably and appropriately decreased, and the fixing belt 133 is rotated in this stable state.

In addition, in the first to third modified examples described above, although the corner of each guide member 135 facing the nip forming member 132 is formed in the R shape, the corner described above does not necessarily need to have the R shape. However, in this case, the resistance acquired when the fixing belt 133 moves between the nip forming member 132 and the guide member 135 is increased, and there is concern that the rotation of the fixing belt 133 becomes unstable.

Furthermore, as in the first embodiment described above, in winding the fixing belt 133 to pass over the heating roller 131 and the nip forming member 132, the diameter of the heating roller 131 described above is not particularly limited. However, generally, the diameter of the heating roller 131 is preferably 1.5 times the length of the nip portion in the sheet conveying direction, which is formed by the nip forming member 132, or less and is more preferably the length described above or less. In this way, by decreasing the diameter of the heating roller 131, the heat capacity can be decreased, and a warm-up time is shortened, and the energy saving can be improved.

In addition, the image forming apparatus 101 is not limited to that illustrated in FIG. 1 described above but may be an image forming apparatus of any other color form or a monochrome form.

In the fixing device according to the first embodiment described above, by arranging the guide member guiding the fixing belt to a space between the nip forming member and the heating-side member to be separate from the nip forming member described above as described above and arranging the sliding member at least in a contact portion between the nip forming member and the fixing belt, it is prevented that the fixing belt is brought into contact with the nip forming member more than necessary or is brought into contact with a member fixing the nip forming member or the like in accordance with the guide member, the fixing belt is appropriately guided to a space between the nip forming member and the heating-side member, and sliding resistance according to the friction between the fixing belt and the nip forming member is decreased by the sliding member described above, and the fixing belt is stably rotated in a state being brought into tight contact with the nip forming member.

As a result, in an image forming apparatus using the fixing device described above, when a toner image formed on a recording medium is heated and fixed to the recording medium, the fixing belt is stably rotated in a state being brought into tight contact with the nip forming member, and appropriate image formation is stably performed.

[Second Embodiment]

(Image Forming Apparatus 200)

An image forming apparatus 200 according to the second embodiment will be described with reference to FIGS. 7 to 10.

Figure 7:
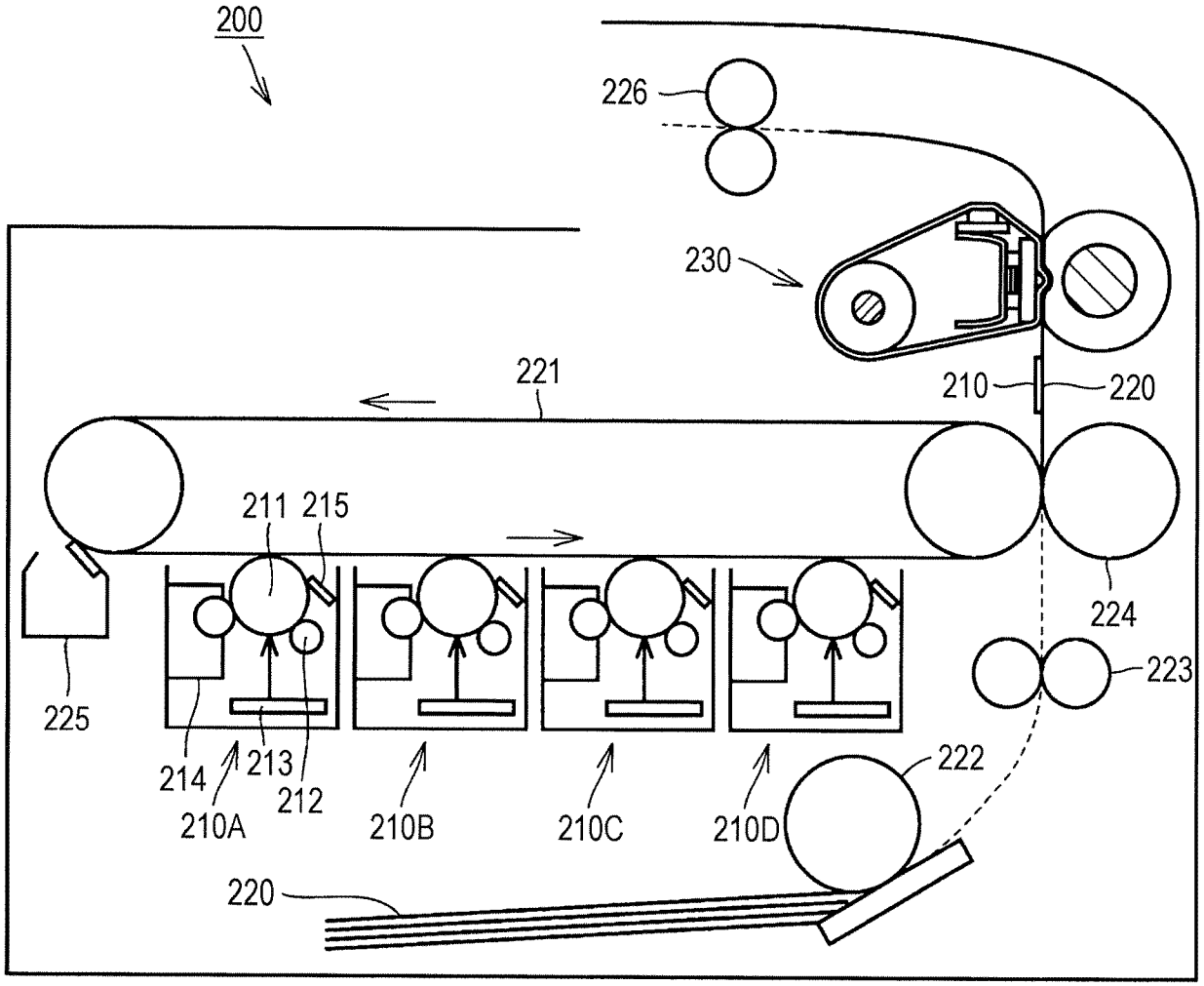
FIG. 7 is a diagram that illustrates an image forming apparatus according to a second embodiment.

As illustrated in FIG. 7, the image forming apparatus 200 includes: image forming units 210A to 210D; an intermediate transfer belt 221; a sheet feed roller 222; a timing roller 223; a transfer roller 224; a cleaning device 225; a sheet discharge roller 226; and a fixing device 230.

Each of the image forming units 210A to 210D includes a photosensitive body 211, a charging device 212, an exposure device 213, a developing device 214, and a cleaning device 215. Toner images of colors respectively formed by the image forming units 210A to 210D are sequentially transferred onto the intermediate transfer belt 221 and are composed on the intermediate transfer belt 221.

A recording material 220 is conveyed by the sheet feed roller 222 and the timing roller 223. The toner images on the intermediate transfer belt 221 are transferred onto the surface of the recording material 220 between the intermediate transfer belt 221 and the transfer roller 224. On the surface of the recording material 220, an unfixed image 210 is formed.

(Fixing Device 230)

Figure 8:
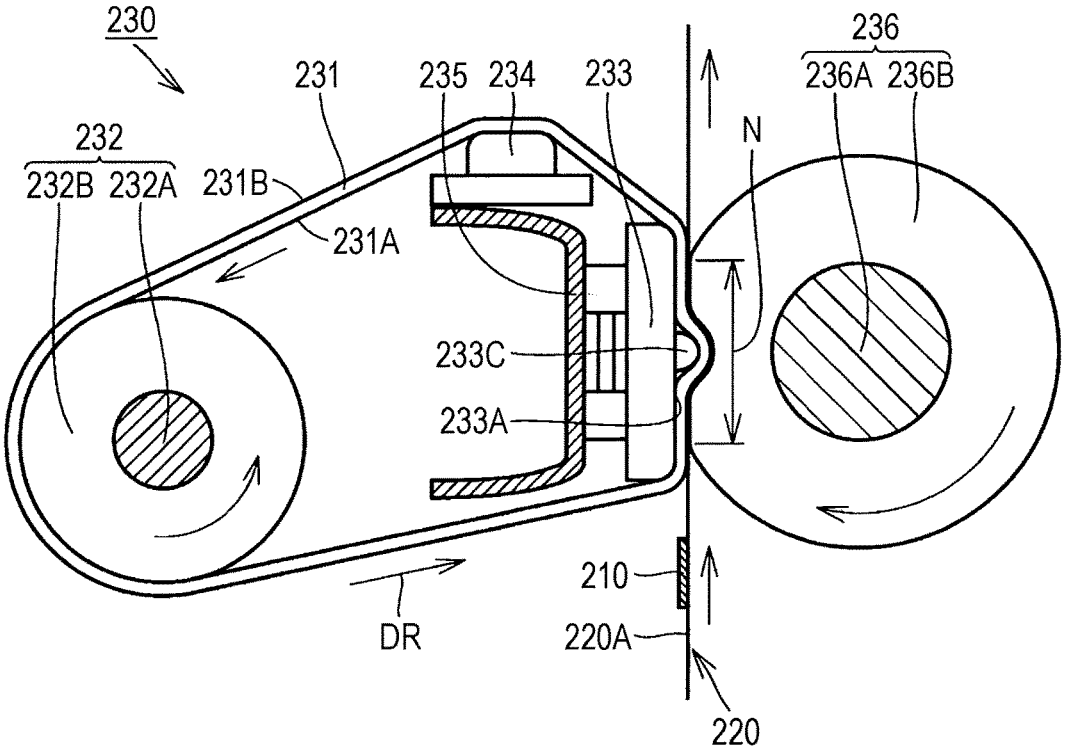
FIG. 8 is a diagram that illustrates a fixing device according to the second embodiment.

FIG. 8 is a diagram that illustrates the fixing device 230 according to the second embodiment. The fixing device 230 fixes an unfixed image 210 on the surface 220A of a recording material 220 through pressurization and heating by passing the recording material 220 having the surface 220A on which the unfixed image 210 is formed to pass through a fixing nip N. More specifically, the fixing device 230 includes a heating member 231, a heater 232, a nip forming member 233, a lubricant coating member 234, a support member 235, and a pressing member 236.

The heating member 231 includes an inner circumferential surface 231A and an outer circumferential surface 231B. The heating member 231 has the shape of an endless belt and can be moved to rotate along the circumferential direction (the direction of an arrow DR). All the heater 232, the nip forming member 233, the lubricant coating member 234, and the support member 235 are arranged on the inner circumferential surface 231A side of the heating member 231.

The heater 232 includes a heat source 232A and a heating roller 232B as constituent elements thereof. The heat source 232A, for example, is configured by a halogen heater or a carbon heater and heats the heating member 231 through the heating roller 232B by being conductive.

The heater 232 is arranged to heat the heating member 231 at a position other than a position at which the fixing nip N is formed. In the case of being seen in the circumferential direction (arrow DR) of the heating member 231, the heating member 231 is heated by the heater 232 at a position (here, a position disposed on the opposite side of the fixing nip N) other than the position of the fixing nip N in the circumferential direction.

The lubricant coating member 234 has a shape extending in the longitudinal direction (a direction perpendicular to the sheet face of FIG. 8) of the fixing nip N to be described later. The lubricant coating member 234 is arranged to be brought into contact with the inner circumferential surface 231A of the heating member 231 and supplies lubricant to the inner circumferential surface 231A. The lubricant is supplied to a space between the inner circumferential surface 231A of the heating member 231 and the nip forming member 233 in accordance with the rotary movement of the heating member 231.

The support member 235 has a shape extending along the longitudinal direction (a direction perpendicular to the sheet face of FIG. 8) of the fixing nip N to be described later as well. Both ends of the support member 235 in the longitudinal direction are fixed to a casing (not illustrated in the drawing) of the fixing device 230 or the like, and the nip forming member 233 is fixed to the casing of the fixing device 230 or the like through the support member 235.

Pressing pressure supplied from the pressing member 236 is applied to the nip forming member 233 through the fixing nip N. The support member 235 supports the nip forming member 233 from the rear face side of the nip forming member 233, thereby opposing the pressing pressure. The support member 235 fixes the nip forming member 233 to a predetermined position and prevents the nip forming member 233 from deviating from the predetermined position.

The pressing member 236 is arranged to be in contact with the outer circumferential surface 231B of the heating member 231. The pressing member 236 presses the nip forming member 233 to be described later (more specifically, an opposing face 233A of the nip forming member 233) through the heating member 231. Between the outer circumferential surface of the pressing member 236 and the outer circumferential surface 231B of the heating member 231, a fixing nip N having a desired nip width is formed.

The pressing member 236 according to this embodiment includes a core 236A and an elastic layer 236B disposed to surround the outer surface of the core 236A. The elastic layer 236B is formed using expandable silicone rubber, silicone rubber, fluorine rubber, or the like. On the surface layer of the elastic layer 236B, a releasing layer of PFA, PTFE, or the like may be disposed.

A driving mechanism not illustrated in the drawing is connected to both ends of the pressing member 236 in the longitudinal direction, and the pressing member 236 rotates in the direction of an arrow (clockwise direction) illustrated in FIG. 8. The heating member 231 is driven to rotate according to a rotation force of the pressing member 236. Inside the pressing member 236, a heat source such as a halogen heater may be disposed.

(Nip Forming Member 233)

Figure 9:
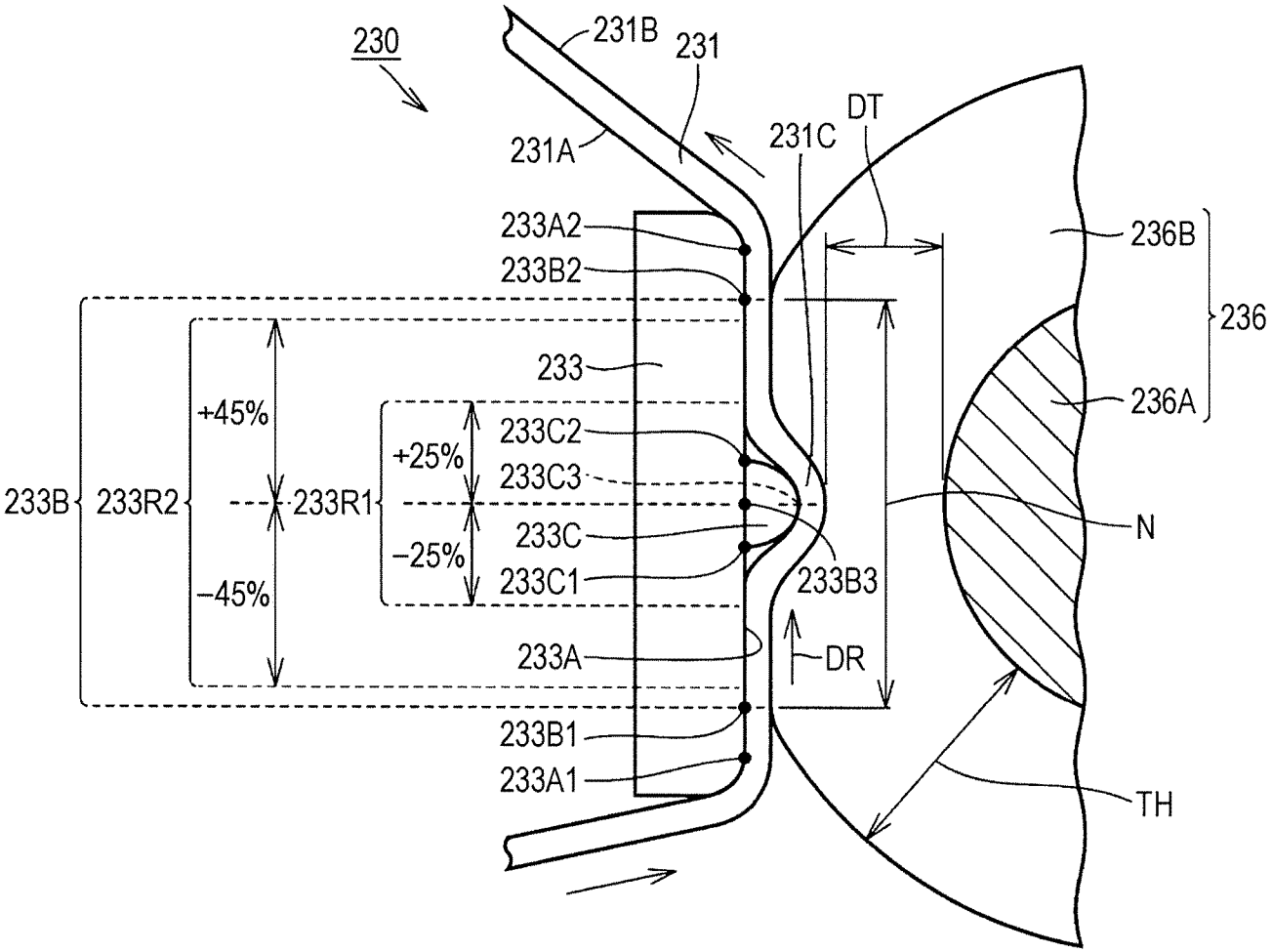
FIG. 9 is a diagram that illustrates a part of the fixing device according to the second embodiment in an enlarged scale.
Figure 10:
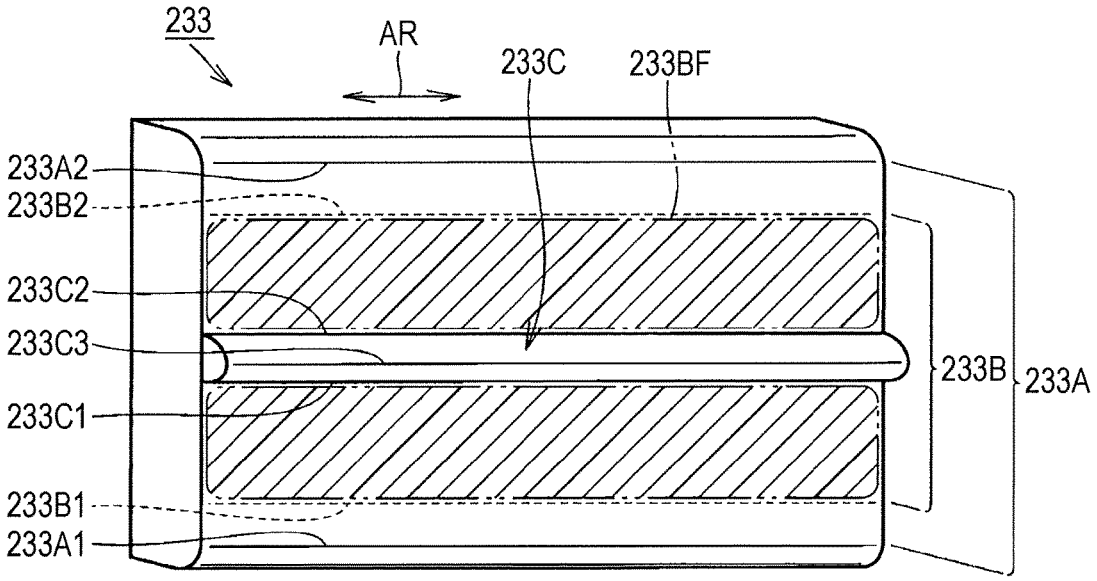
FIG. 10 is a perspective view that illustrates a nip forming member included in the fixing device according to the second embodiment.

FIG. 9 is a diagram that illustrates a part (near the fixing nip N) of the fixing device 230. FIG. 10 is a perspective view that illustrates the nip forming member 233. The nip forming member 233 is arranged on the pressing member 236 side when viewed from the support member 235 (FIG. 9). The nip forming member 233 can be formed from a resin member having a heat resisting property. For example, a liquid crystal polymer (LCP), a polyimide resin, a polyamide-imide resin (PAI), or the like is used.

The nip forming member 233 includes a non-rotating opposing face 233A. The opposing face 233A is a portion of the nip forming member 233 that faces the pressing member 236 through the heating member 231. The nip forming member 233 is arranged such that a part or the whole of the opposing face 233A is brought into contact with the inner circumferential surface 231A of the heating member 231.

The opposing face 233A according to this embodiment is formed between an upstream end portion 233A1 and a downstream end portion 233A2 (FIGS. 9 and 10). The upstream end portion 233A1 is a portion of the opposing face 233A that is positioned on the upstream-most side in the circumferential direction (arrow DR) of the heating member 231. The downstream end portion 233A2 is a portion of the opposing face 233A that is positioned on the downstream-most side in the circumferential direction (arrow DR) of the heating member 231.

Each of the upstream end portion 233A1 and the downstream end portion 233A2 defining parts of the outer edge of the opposing face 233A has a shape extending along a direction parallel to the longitudinal direction (arrow AR) of the fixing nip N (see FIG. 10). A portion of the opposing face 233A except for a portion at which a convex part 233C (first convex part) to be described later is disposed has a flat surface shape. While detailed description will be presented later, the portion of the opposing face 233A except for the portion at which the convex part 233C is disposed corresponds to two flat areas 233BF to which hatching of diagonal lines is applied in FIG. 10.

(Nip Forming Range 233B)

The opposing face 233A includes a nip forming range 233B defining the shape of the fixing nip N. The nip forming range 233B is a part of the opposing face 233A. The nip forming range 233B is a part, which defines the shape of the fixing nip N (provided for the formation of the fixing nip N), of the opposing face 233A and is pressed by the pressing member 236 when the opposing face 233A of the nip forming member 233 is pressed by the pressing member 236 through the heating member 231.

The nip forming range 233B according to this embodiment is formed between the upstream end portion 233B1 and the downstream end portion 233B2 (FIGS. 9 and 10). The upstream end portion 233B1 is a portion of the nip forming range 233B that is positioned on the upstream-most side in the circumferential direction (arrow DR) of the heating member 231. The downstream end portion 233B2 is a portion of the nip forming range 233B that is positioned on the downstream-most side in the circumferential direction (arrow DR) of the heating member 231.

Each of the upstream end portion 233B1 and the downstream end portion 233B2 defining parts of the outer edge of the nip forming range 233B has a shape extending along a direction parallel to the longitudinal direction (arrow AR) (see FIG. 10) of the fixing nip N.

(Convex Part 233C)

In the nip forming range 233B, the convex part 233C (first convex part) having a shape protruding toward the fixing nip N side is disposed. The convex part 233C is disposed at a position other than the positions of the downstream end portion 233B2 and the upstream end portion 233B1 of the nip forming range 233B in the circumferential direction of the heating member 231. In other words, the convex part 233C is disposed at a position not overlapping the downstream end portion 233B2 and the upstream end portion 233B1.

As illustrated in FIG. 10, the convex part 233C according to this embodiment has a shape extending in a linear shape along a direction parallel to the longitudinal direction of the fixing nip N. However, the configuration is not limited to such a configuration, but the convex part 233C may be configured to have an extending shape of a curved line such that the center is positioned on a further front side or a further rear side in the circumferential direction than both ends thereof. In addition, the configuration is not limited to such a configuration, but the convex part 233C may be configured such that a plurality of linear portions having a relatively short length are intermittently present along a direction parallel to the longitudinal direction of the fixing nip N. According to the configuration of the curved line or the intermittent top field configuration, a shearing force to be described later can be configured to be different for each position in the longitudinal direction.

By referring to FIG. 9, in a case where a cross-sectional shape of a plane direction orthogonal to the longitudinal direction (an arrow AR illustrated in FIG. 10) of the fixing nip N is seen, in the circumferential direction of the heating member 231, between a portion (the flat area 233BF of the upstream side) of the opposing face 233A positioned on the upstream side of the convex part 233C and the convex part 233C, a first inflection point 233C1 is formed. In the circumferential direction of the heating member 231, between a portion (the flat area 233BF of the downstream side) of the opposing face 233A positioned on the downstream side of the convex part 233C and the convex part 233C, a second inflection point 233C2 is formed.

An inflection point described here represents a point at which a curve changes between a convex state and a concave state, and one side and the other side of the curve are present on mutually-different sides with a tangential line acquired by drawing out at this point being a boundary. In other words, a point at which the concave/convex state of a curve changes is an inflection point. In other words, a curve having an inflection point can be regarded as a curve in which at least one or more concave portions and convex portions are present.

The convex part 233C has a cross-sectional shape of a semicircle. A distance between the first inflection point 233C1 and the second inflection point 233C2, in other words, a width of the convex part 233C in the circumferential direction (the arrow DR), for example, is 1.0 mm. A height of the convex part 233C in the protruding direction, for example, is 0.5 mm. In FIGS. 7 to 10 and the like, for the convenience of drawing, while the convex part 233C is displayed in a size larger than the actual size, the width and the height of the convex part 233C are not limited to such values and the sizes and the shapes illustrated in the drawings.

(Action and Effect)

As described above, as one of techniques for decreasing the power consumption of the fixing device, it is considered to lower the fixing temperature. In a case where the fixing temperature is lowered, in order to suppress degradation of the image quality (fixing quality), it is necessary to employ a certain countermeasure.

As the countermeasure, a technique of forming a pressure distribution in which the contact pressure of a part in the circumferential direction (the arrow DR illustrated in FIG. 9) inside the fixing nip N is locally increased inside the fixing nip N may be considered. In a case where such a technique is employed, toner on the recording material 220, which is melted, drastically permeates the inside of the recording material 220, a shearing force (slip force) is generated between the heating member 231 and the toner surface at a position corresponding to the convex part 233C, and a shearing force is applied to the toner at a position corresponding to the convex part 233C, whereby a relation between the toner and the surface 220A of the recording material 220 can be solidified more.

In this embodiment, the convex part 233C is disposed at a position other than the downstream end portion 233B2 and the upstream end portion 233B1 of the nip forming range 233B in the circumferential direction of the heating member 231. According to the presence of the convex part 233C, the heating member 231 is locally deformed when being rotated and moved inside the fixing nip N, and, according to the heating member 231 deformed in this way, a position at which the contact pressure is locally increased is formed inside the fixing nip N.

In a case where the convex part 233C is disposed at the position of the upstream end portion 233B1 of the nip forming range 233B, in other words, in a case where the convex part 233C is disposed to overlap the upstream end portion 233B1 of the nip forming range 233B, there is concern that the presence of the convex part 233C has influence on the curl quality. On the other hand, in a case where the convex part 233C is disposed at the position of the downstream end portion 233B2 of the nip forming range 233B, in other words, in a case where the convex part 233C is disposed to overlap the downstream end portion 233B2 of the nip forming range 233B, there is concern that there is influence on the offset.

In the fixing device 230 according to this embodiment, one convex part 233C is disposed at the position other than the downstream end portion 233B2 and the upstream end portion 233B1. Accordingly, also in a case where the fixing temperature is lowered, degradation of the image quality (fixing quality) can be suppressed according to the presence of the convex part 233C, and, the convex part 233C is disposed at a position other than the downstream end portion 233B2 and the upstream end portion 233B1, and accordingly, the degradation of the curl quality or the offset due to the presence of the convex part 233C hardly occurs. In addition, according to the presence of the first inflection point 233C1 and the second inflection point 233C2, the pressure distribution can be changed more locally.

[Experimental Example 1]

A result of an experiment performed for checking the effect of the convex part 233C (first convex part) described above will be described with reference to FIG. 11. In a fixing device (a fixing device including the nip forming member 233 illustrated in FIGS. 9 and 10) having the same configuration as the fixing device 230 according to the second embodiment and a fixing device having a nip forming member 233 in which the convex part 233C is not disposed were prepared.

The convex part 233C was configured to have a cross-sectional shape of a semi-circle, the width of the convex part 233C in the circumferential direction (arrow DR) was set to 1.0 mm, and the height of the convex part 233C in the protruding direction was set to 0.5 mm. For such fixing devices, fixing temperature for acquiring specific fixing quality (same fixing quality) was measured.

Figure 11:
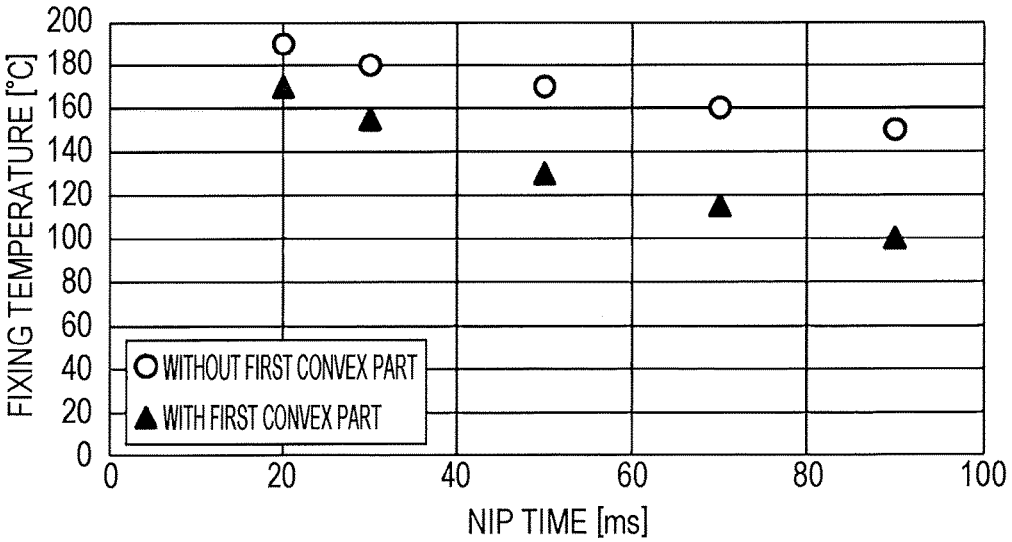
FIG. 11 is a diagram that illustrates an experiment result of Experimental example 1.

As a result, as illustrated in FIG. 11, it can be understood that the fixing temperature can be set to be lower regardless of a nip time in the fixing device having the nip forming member 233 in which the convex part 233C is disposed than the fixing device having the nip forming member 233 in which the convex part 233C is not disposed. Therefore, according to the fixing device 230 of the second embodiment described above, it can be stated that, also in a case where the fixing temperature is set to be low, degradation of the image quality (fixing quality) can be suppressed according to the presence of the convex part 233C.

[Experimental Example 2]

Figure 12:
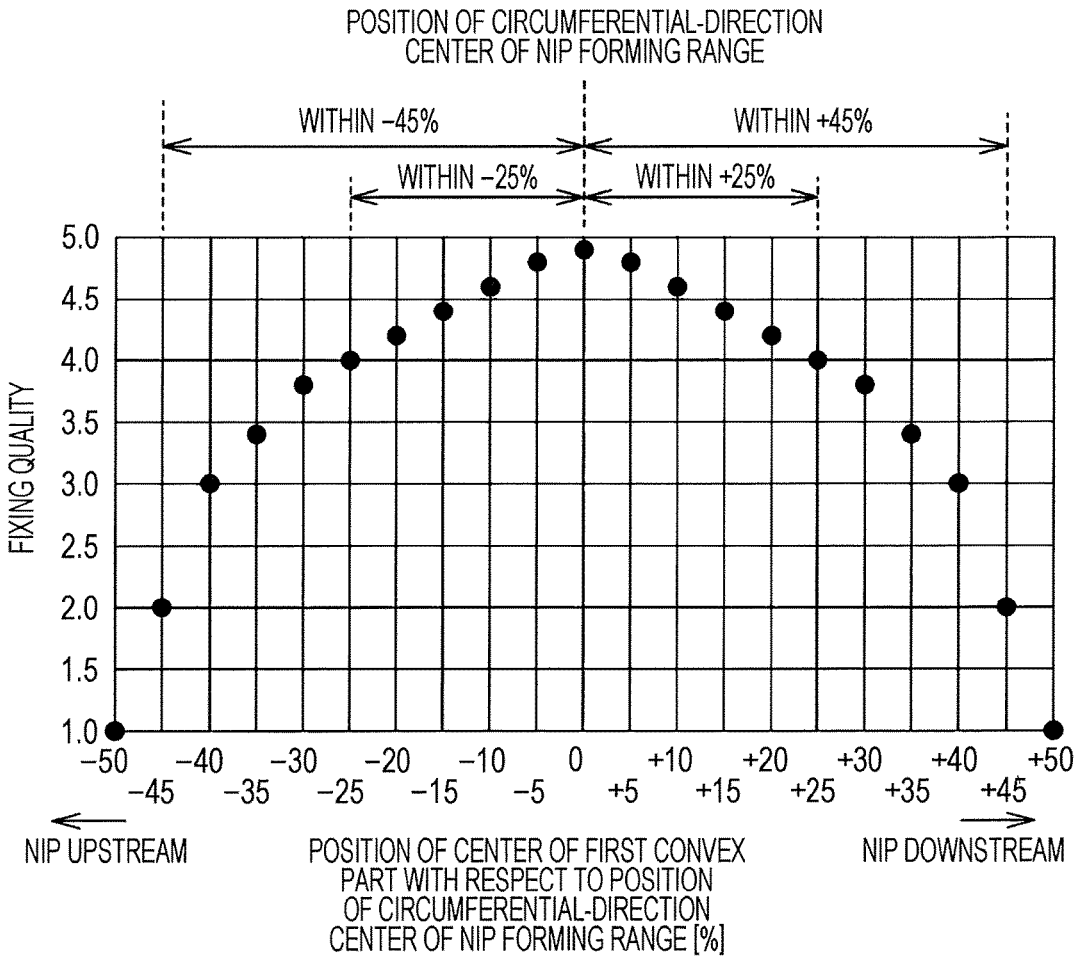
FIG. 12 is a diagram that illustrates an experiment result of Experimental example 2.

By referring to FIGS. 9 and 12, in a case where the convex part 233C is disposed in the nip forming member 233, the effect of the position of a center portion 233C3 (FIG. 9) of the convex part 233C, which is disposed in the nip forming range 233B, in the circumferential direction on the fixing quality was verified.

Similarly to Experimental example 1, the convex part 233C was configured to have a cross-sectional shape of a semi-circle, the width of the convex part 233C in the circumferential direction (arrow DR) was set to 1.0 mm, and the height of the convex part 233C in the protruding direction was set to 0.5 mm.

In FIG. 12, the vertical axis represents the fixing quality. This fixing quality is measured using a colorimeter, and, after an external force is applied to a toner image (patch image) after fixation under a same condition, the residual amount of toner per unit area that remains in the toner image was measured using the colorimeter. A higher value of the fixing quality represents a larger residual amount of toner and higher fixing quality.

In FIG. 12, the horizontal axis represents the position of the center portion 233C3 of the convex part 233C with respect to the position of the center 233B3 of the nip forming range 233B in the circumferential direction (arrow DR). Here, the position of the center 233B3 of the nip forming range 233B in the circumferential direction (arrow DR) is represented as 0%, the position of the downstream end portion 233B2 of the nip forming range 233B is represented as +50%, and the position of the upstream end portion 233B1 of the nip forming range 233B is represented as −50%.

As a result, as illustrated in FIG. 12, in a case where the center portion 233C3 of the convex part 233C in the circumferential direction is positioned in the range of ±25% (in the range 233R1 illustrated in FIG. 9) of the length of the nip forming range 233B in the circumferential direction from the position of the center 233B3 of the nip forming range 233B in the circumferential direction, it can be understood that the fixing quality is 4.0 or more. Accordingly, it can be stated that the center portion 233C3 of the convex part 233C in the circumferential direction is preferably positioned within this range 233R1. In addition, it can be stated that the center portion 233C3 of the convex part 233C in the circumferential direction is more preferably positioned at the center 233B3 of the nip forming range 233B in the circumferential direction.

In addition, as described above, in a case where the convex part 233C is disposed at the position of the upstream end portion 233B1 of the nip forming range 233B, in other words, in a case where the convex part 233C is disposed to overlap the upstream end portion 233B1 of the nip forming range 233B, there is concern that the presence of the convex part 233C has influence on the curl quality. On the other hand, in a case where the convex part 233C is disposed at the position of the downstream end portion 233B2 of the nip forming range 233B, in other words, in a case where the convex part 233C is disposed to overlap the downstream end portion 233B2 of the nip forming range 233B, there is concern that there is influence on the offset.

Accordingly, it can be stated that the convex part 233C is preferably formed such that the entirety thereof is formed to be included within the range (the range 233R2 illustrated in FIG. 9) of ±45% in the circumferential direction from the position of the center 233B3 of the nip forming range 233B in the circumferential direction. By configuring such that neither at least a part of the convex part 233C is formed at a position above 45% nor at least a part of the convex part 233C is formed at a position below −45%, there is almost no concern described above.

[Experimental Example 3]

Figure 13:
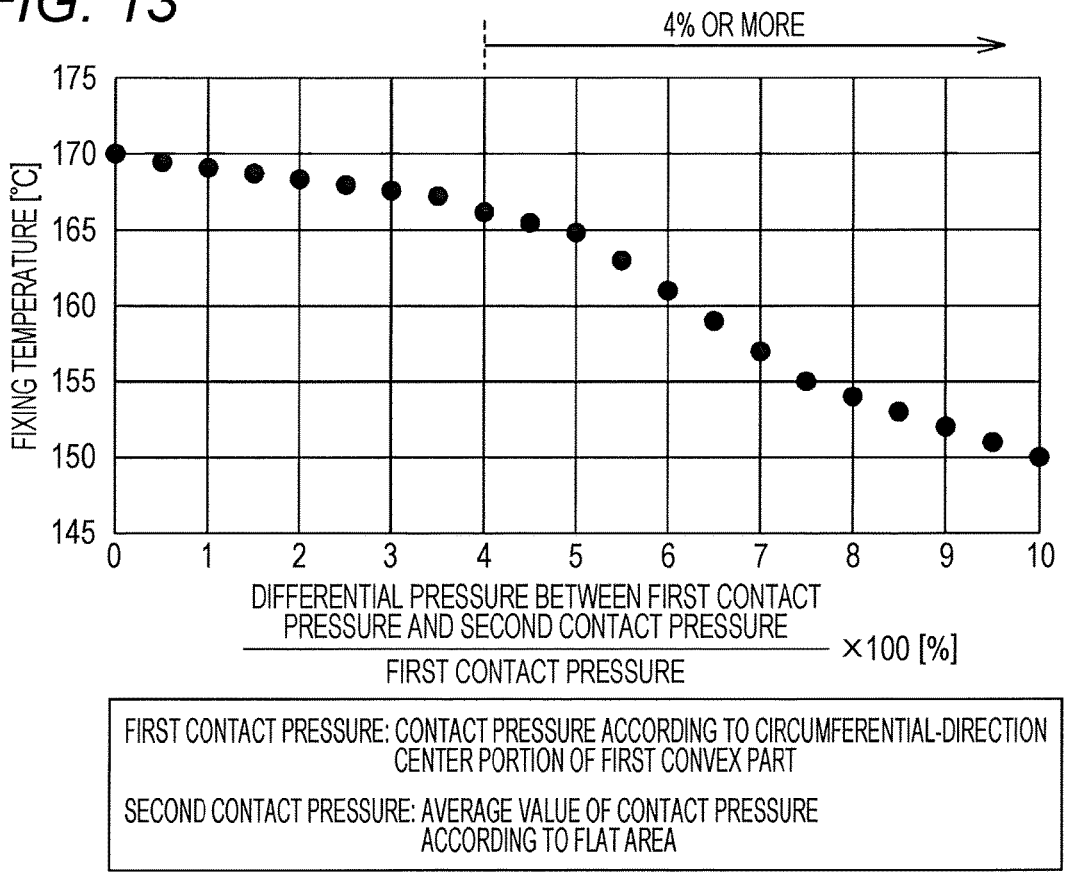
FIG. 13 is a diagram that illustrates an experiment result of Experimental example 3.

By referring to FIGS. 9 and 13, in a case where the convex part 233C is arranged in the nip forming member 233, the influence of a relation between the contact pressure according to the center portion 233C3 (FIG. 9) of the convex part 233C in the circumferential direction and an average value of the contact pressure according to the flat area 233BF (FIG. 10) of the nip forming range 233B in which the convex part 233C is not disposed on the fixing temperature was verified.

Here, as described above, an area of the nip forming range 233B of the nip forming member 233 in which the convex part 233C is not disposed is the flat area 233BF (FIG. 10). A contact pressure that is received by a portion of the heating member 231 that is in contact with the center portion 233C3 of the convex part 233C in the circumferential direction from the pressing member 236 will be referred to as a first contact pressure. In addition, an average value of the contact pressure that is received by a portion of the heating member 231 that is in contact with the flat area 233BF from the pressing member 236 will be referred to as a second contact pressure.

In FIG. 13, the horizontal axis represents the value of (a differential pressure between the first contact pressure and the second contact pressure)/the first contact pressure in a percentage. The convex part 233C was configured to have a cross-sectional shape of a semi-circle, and the width of the convex part 233C in the circumferential direction (arrow DR) was set to 1.0 mm. In order to change the value of (the differential pressure between the first contact pressure and the second contact pressure)/the first contact pressure, fixing devices having convex parts 233C of mutually-different heights in the protruding direction were prepared. Necessary fixing temperatures for acquiring specific fixing quality (same fixing quality) were measured for such fixing devices.

As a result, as illustrated in FIG. 13, in a case where (the differential pressure between the first contact pressure and the second contact pressure)/the first contact pressure is larger than 0%, also in a case where the fixing temperature is lowered, it can be stated that degradation of the image quality (fixing quality) can be suppressed according to the presence of the convex part 233C. In addition, according to a result illustrated in FIG. 13, it can be understood that (the differential pressure between the first contact pressure and the second contact pressure)/the first contact pressure is preferably 4% or more.

[Experimental Example 4]

Figure 14:
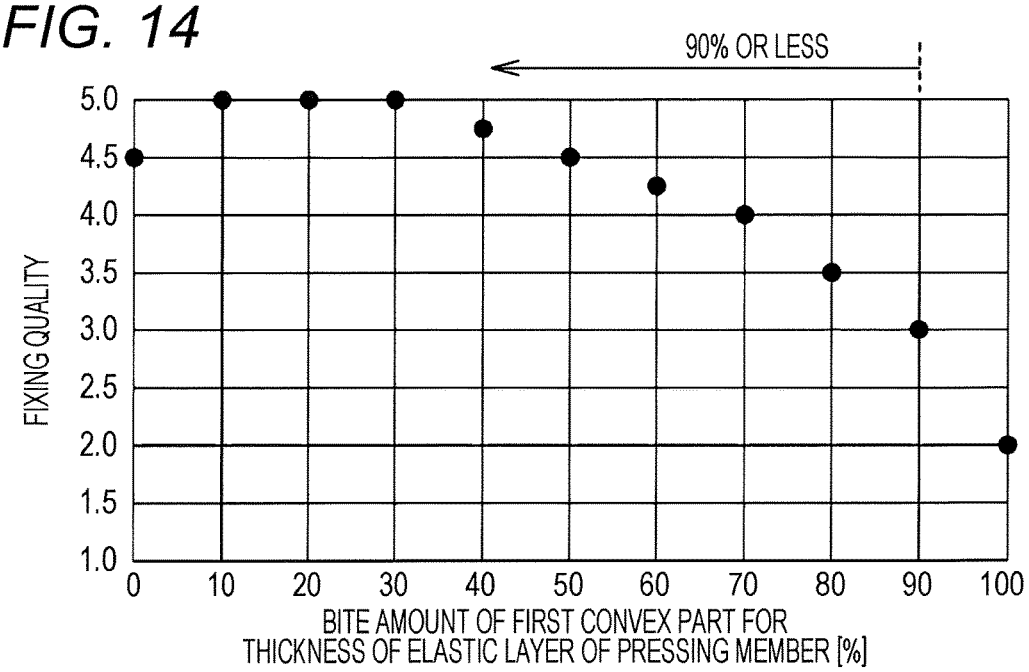
FIG. 14 is a diagram that illustrates an experiment result of Experimental example 4.

By referring to FIGS. 9 and 14, the influence of the bite-in amount of the convex part 233C (first convex part) for the thickness TH of the elastic layer 236B of the pressing member 236 on the fixing quality was verified. The convex part 233C was configured to have a cross-sectional shape of a semi-circle, the width of the convex part 233C in the circumferential direction (arrow DR) was set to 1.0 mm, and the height of the convex part 233C in the protruding direction was set to 0.5 mm.

Here, a part of the heating member 231 is bitten by the elastic layer 236B in accordance with the presence of the convex part 233C. The thickness of a portion of the elastic layer 236B not receiving a contact pressure from the heating member 231 will be denoted by TH. In addition, a distance between a part 231C of the heating member 231 that is bitten by the elastic layer 236B and the core 236A will be denoted by DT. A value of (the thickness TH−the distance DT) is defined as a bite amount.

For example, in a case where the thickness TH of the elastic layer 236B is 5.0 mm, and the distance DT between the part 231C of the heating member 231 that is bitten by the elastic layer 236B and the core 236A is 4.0 mm, the bite amount (the thickness TH−the distance DT) is 1.0 mm and is 20% when represented in a percentage. The influence on the fixing quality at the time of changing the bite amount from 0 to 100% was verified.

Here, by changing the load for the nip forming member 233 of the pressing member 236, the bite amount was changed. The fixing quality represented in the vertical axis illustrated in FIG. 14 is a result of visual checking using a rank sample. A higher value of the fixing quality represents higher fixing quality (superior).

According to a result represented in FIG. 14, also in a case where the bite amount is 0% of the thickness TH, it can be understood that high fixing quality is acquired according to the presence of the convex part 233C (first convex part). In addition, in a case where the bite amount is 90% of the thickness TH or less, it can be understood that fixing quality of 3.0 or more is acquired. Accordingly, it can be stated that the bite amount of the convex part 233C (first convex part) for the thickness TH of the elastic layer 236B of the pressing member 236 is preferably 90% of the thickness TH or less.

[Third Embodiment]

A fixing device according to the third embodiment will be described with reference to FIG. 15. In the second embodiment described above, the convex part 233C has a same protrusion height at any position in the longitudinal direction of the fixing nip N. The protrusion height of the convex part 233C may be configured to be different according to the position in the longitudinal direction of the fixing nip N.

Figure 15:
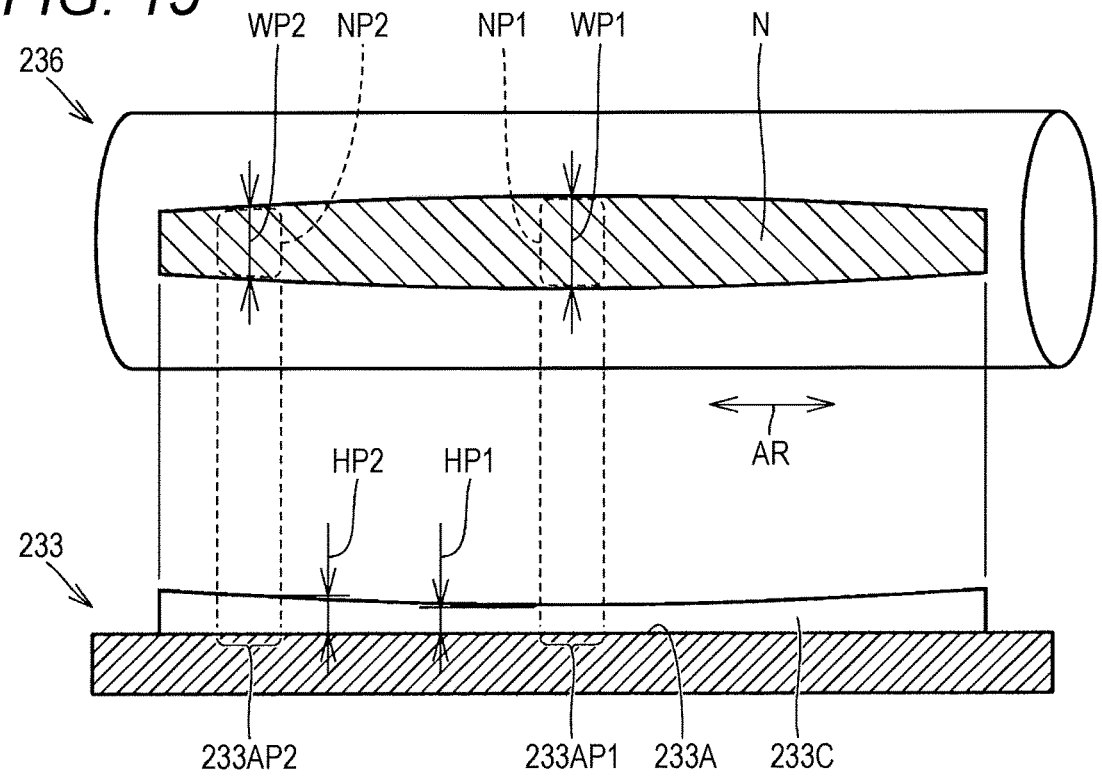
FIG. 15 is a diagram that illustrates a pressing member and a nip forming member included in a fixing device according to a third embodiment.

As illustrated in FIG. 15, for example, the fixing nip N includes a wide area NP1 and a narrow area NP2. The wide area NP1 includes a predetermined nip width WP1 in the circumferential direction. The narrow area NP2 is disposed at a position different from the position of the wide area NP1 in the longitudinal direction (arrow AR) of the fixing nip N and has a nip width WP2 narrower than the wide area NP1. In the longitudinal direction (arrow AR) of the fixing nip N, the wide area NP1 is positioned on a further inner side than the narrow area NP2.

In such a case, the convex part 233C of the nip forming member 233 includes a part of the convex part 233C that is disposed in a portion 233AP1 of the opposing face 233A defining the shape of the wide area NP1 and another part of the convex part 233C disposed in a portion 233AP2 of the opposing face 233A defining the shape of the narrow area NP2. The protrusion height HP1 of the convex part 233C disposed in the portion 233AP1 of the opposing face 233A may be configured to be lower than the protrusion height HP2 of the convex part 233C disposed in the portion 233AP2 of the opposing face 233A. According to this configuration, in the longitudinal direction (arrow AR) of the fixing nip N, the occurrence of variations in the fixing quality can be suppressed.

(Modified Example of Third Embodiment)

In the configuration illustrated in FIG. 15, in the longitudinal direction (arrow AR) of the fixing nip N, the wide area NP1 is positioned on a further inner side than the narrow area NP2.

Figure 16:
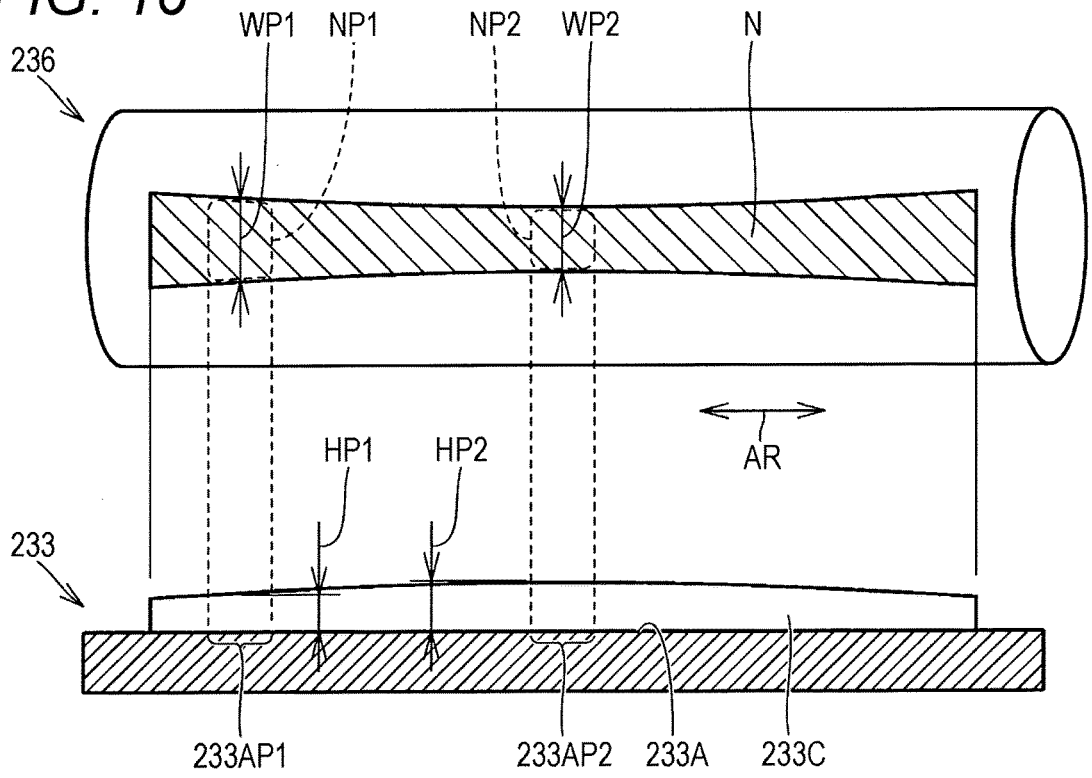
FIG. 16 is a diagram that illustrates a pressing member and a nip forming member included in a fixing device according to a modified example of the third embodiment.

In a configuration illustrated in FIG. 16, in the longitudinal direction (arrow AR) of the fixing nip N, a wide area NPI is positioned on a further outer side than a narrow area NP2. Also in such a configuration, the protrusion height HP1 of the convex part 233C disposed in the portion 233AP1 of the opposing face 233A may be configured to be lower than the protrusion height HP2 of the convex part 233C disposed in the portion 233AP2 of the opposing face 233A. According to this configuration, in the longitudinal direction (arrow AR) of the fixing nip N, the occurrence of variations in the fixing quality can be suppressed.

[Fourth Embodiment]

A fixing device according to the fourth embodiment will be described with reference to FIG. 17. In the second embodiment described above, the contact pressure acting on the fixing nip N is approximately the same at any position in the longitudinal direction of the fixing nip N, and the convex part 233C has a same protrusion height at any position in the longitudinal direction of the fixing nip N. The protrusion height of the convex part 233C may be configured to be different according to the contact pressure acting on the fixing nip N.

Figure 17:
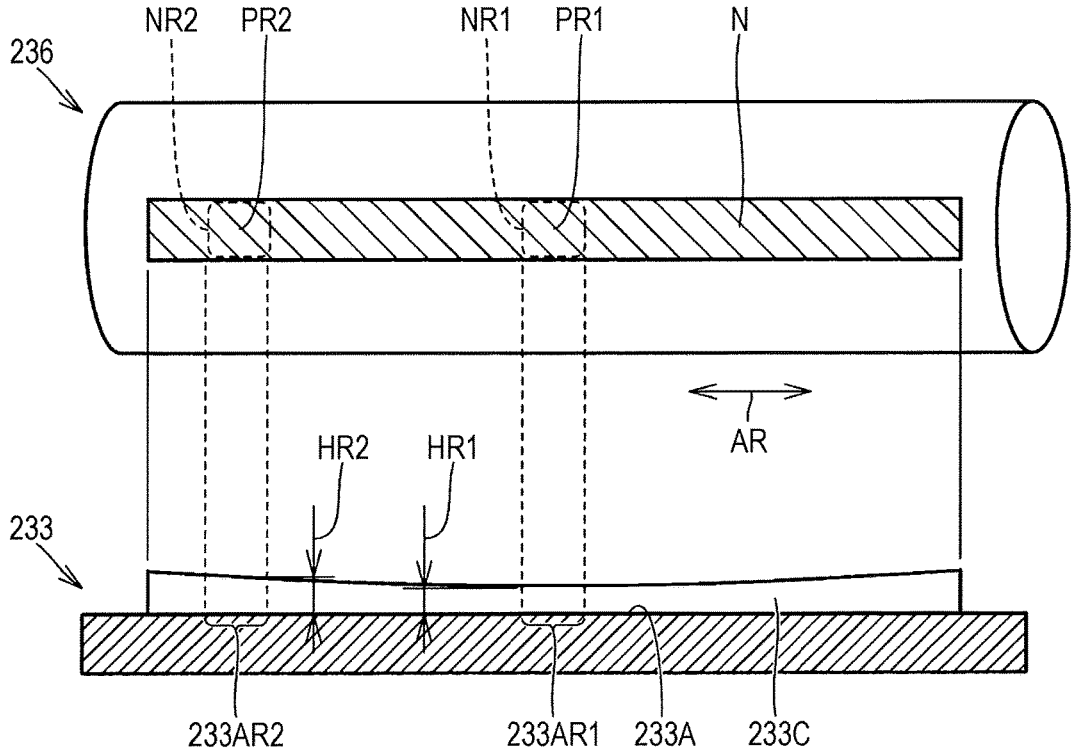
FIG. 17 is a diagram that illustrates a pressing member and a nip forming member included in a fixing device according to a fourth embodiment.

As illustrated in FIG. 17, for example, the fixing nip N is assumed to include a high contact-pressure area NR1 and a low contact-pressure area NR2. A predetermined contact pressure PR1 is applied to the high contact-pressure area NRI. The low contact-pressure area NR2 is disposed at a position different from that of the wide area NP1 in the longitudinal direction (arrow AR) of the fixing nip N and has a contact pressure PR2 lower than that of the high contact-pressure area NR1 applied thereto. In the longitudinal direction (arrow AR) of the fixing nip N, the high contact-pressure area NR1 is positioned on a further inner side than the low contact-pressure area NR2.

In such a case, the convex part 233C of the nip forming member 233 includes a part of the convex part 233C that is disposed in a portion 233AR1 of the opposing face 233A defining the shape of the high contact-pressure area NR1 and another part of the convex part 233C disposed in a portion 233AR2 of the opposing face 233A defining the shape of the low contact-pressure area NR2. The protrusion height HR1 of the convex part 233C disposed in the portion 233AR1 of the opposing face 233A may be configured to be lower than the protrusion height HR2 of the convex part 233C disposed in the portion 233AR2 of the opposing face 233A. According to this configuration, in the longitudinal direction (arrow AR) of the fixing nip N, the occurrence of variations in the fixing quality can be suppressed.

(Modified Example of the Fourth Embodiment)

In the configuration illustrated in FIG. 17, in the longitudinal direction (arrow AR) of the fixing nip N, the high contact-pressure area NR1 is positioned on a further inner side than the low contact-pressure area NR2.

Figure 18:
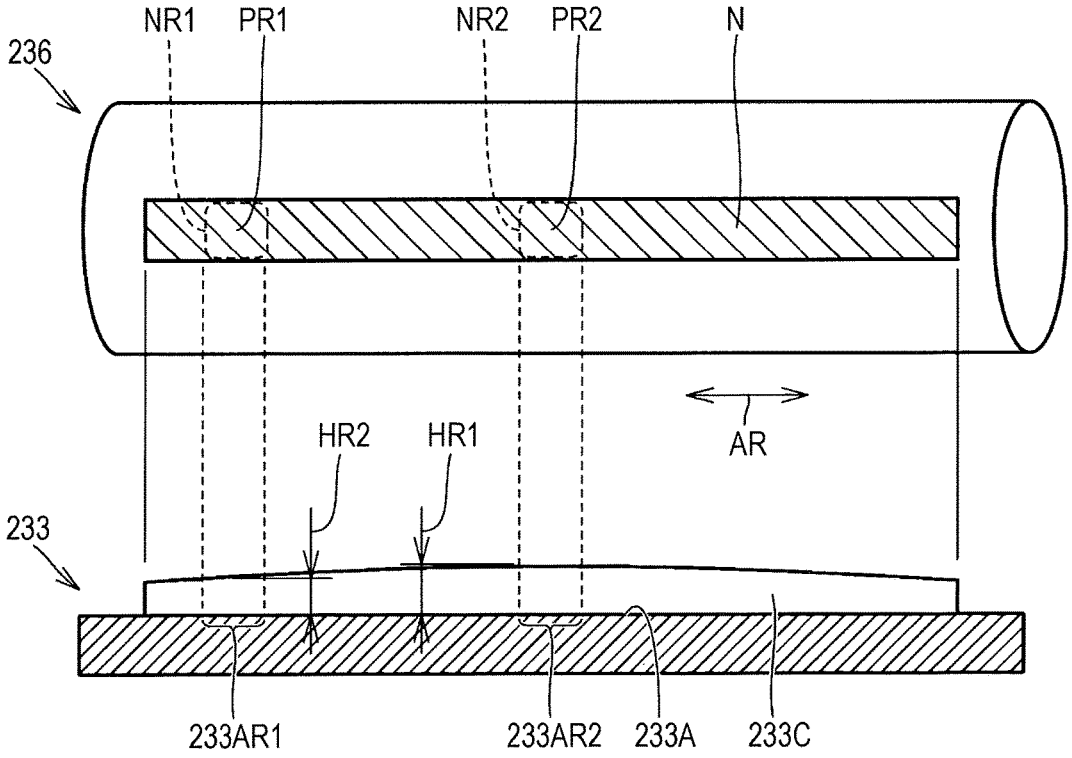
FIG. 18 is a diagram that illustrates a pressing member and a nip forming member included in a fixing device according to a modified example of the fourth embodiment.

In a configuration illustrated in FIG. 18, in the longitudinal direction (arrow AR) of the fixing nip N, the high contact-pressure area NR1 is positioned on a further outer side than the low contact-pressure area NR2. Also in such a configuration, the protrusion height HR1 of the convex part 233C disposed in the portion 233AR1 of the opposing face 233A may be configured to be lower than the protrusion height HR2 of the convex part 233C disposed in the portion 233AR2 of the opposing face 233A. According to this configuration, in the longitudinal direction (arrow AR) of the fixing nip N, the occurrence of variations in the fixing quality can be suppressed.

[Fifth Embodiment]

Figure 19:
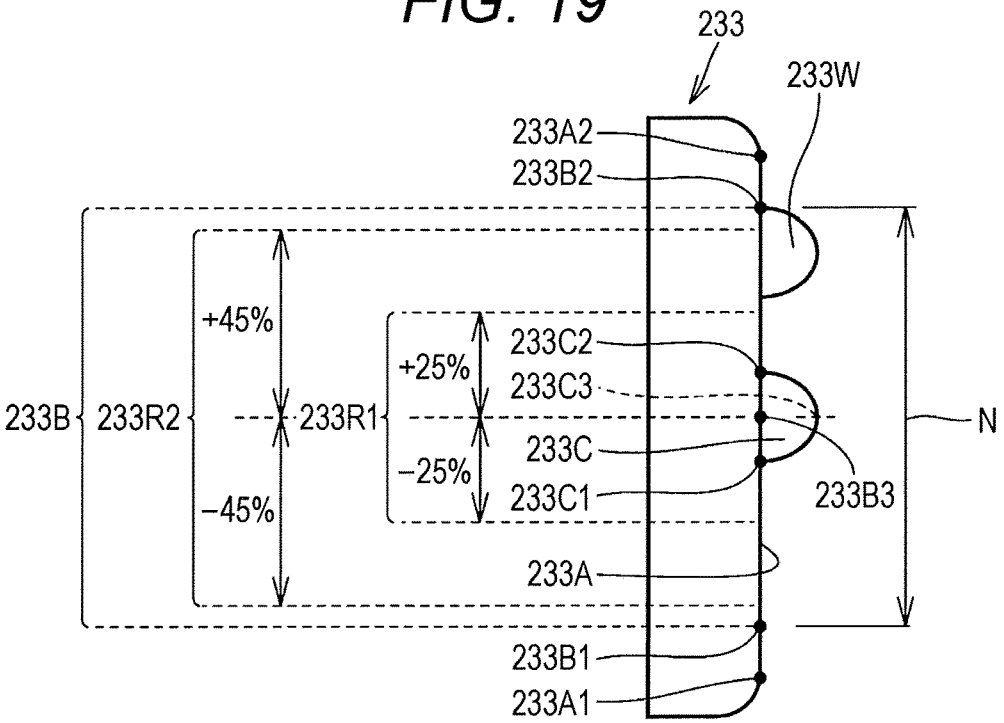
FIG. 19 is a diagram that illustrates a nip forming member included in a fixing device according to a fifth embodiment.

A nip forming member 233 included in a fixing device according to the fifth embodiment will be described with reference to FIG. 19. The nip forming member 233 according to this embodiment has the following additional features in addition to the configuration of the nip forming member 233 according to the second embodiment.

In other words, in a nip forming range 233B, a convex part 233W (second convex part) having a shape protruding toward a fixing nip N side is disposed, and the convex part 233W is disposed at the position of the downstream end portion 233B2 of the nip forming range 233B in the circumferential direction.

According to the presence of the convex part 233W, a heating member 231 is locally deformed when passing through the downstream end of the fixing nip N. According to the heating member 231 deformed in this way, a recording material 220 discharged from the fixing nip N can be easily separated from the heating member 231, and the occurrence of involution and the like of the recording material 220 can be suppressed.

[Sixth Embodiment]

Figure 20:
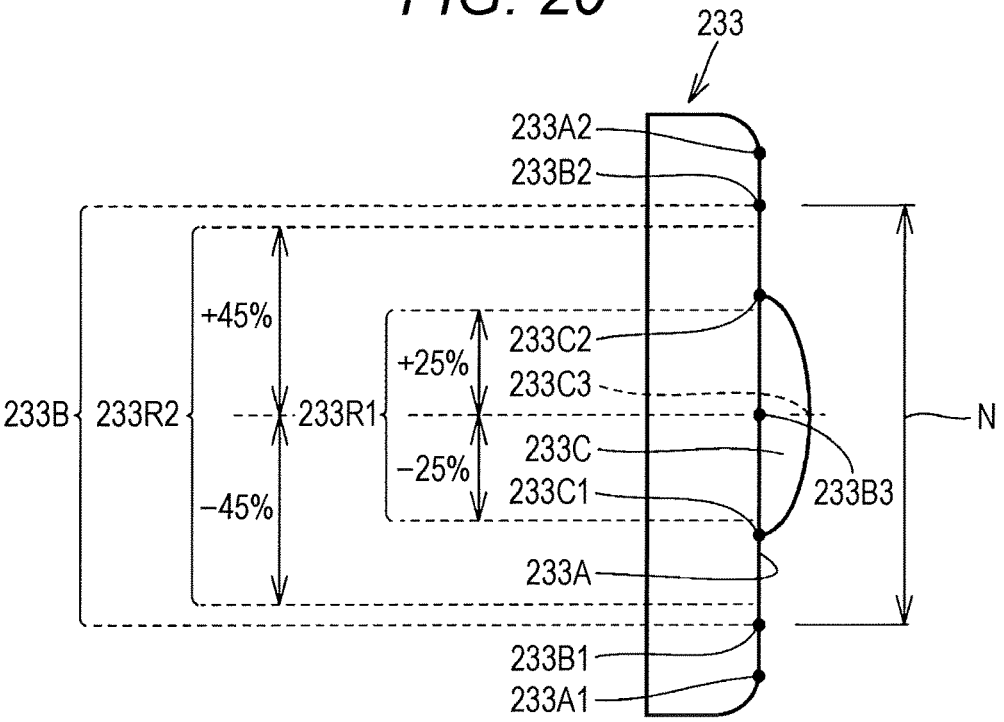
FIG. 20 is a diagram that illustrates a nip forming member included in a fixing device according to a sixth embodiment.

FIG. 20 is a diagram that illustrates a nip forming member 233 included in a fixing device according to the sixth embodiment. In this nip forming member 233, a first inflection point 233C1 and a second inflection point 233C2 respectively positioned upstream and downstream of a convex part 233C in the circumferential direction are positioned on the outside of the range of ±25% of the length of a nip forming range 233B in the circumferential direction from the position of the center 233B3 of the nip forming range 233B in the circumferential direction. In addition, this convex part 233C is formed such that the entirety thereof is included within the range (range 233R2) of ±45% in the circumferential direction from the position of the center 233B3 of the nip forming range 233B in the circumferential direction. The nip forming member 233 and the convex part 233C may be configured to have such shapes.

[Seventh Embodiment]

Figure 21:
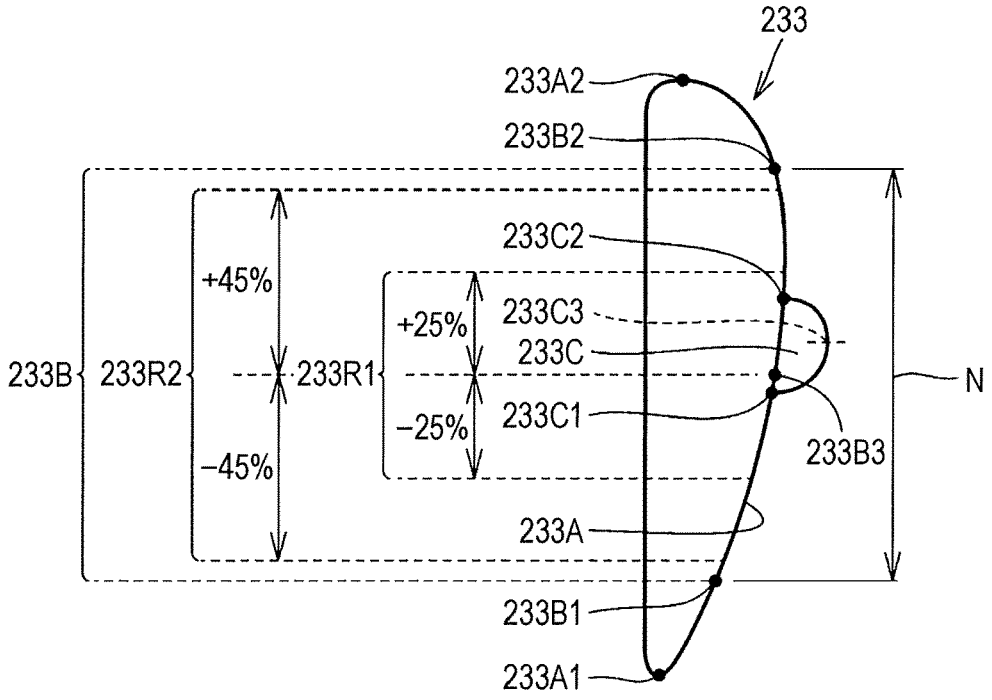
FIG. 21 is a diagram that illustrates a nip forming member included in a fixing device according to a seventh embodiment.

FIG. 21 is a diagram that illustrates a nip forming member 233 included in a fixing device according to the seventh embodiment. In this nip forming member 233, an opposing face 233A has the shape of a curved face curving in an arc shape toward the side of a pressing member 236 not illustrated in the drawing. The nip forming member 233 and the opposing face 233A may be configured to have such shapes.

[Eighth Embodiment]

Figure 22:
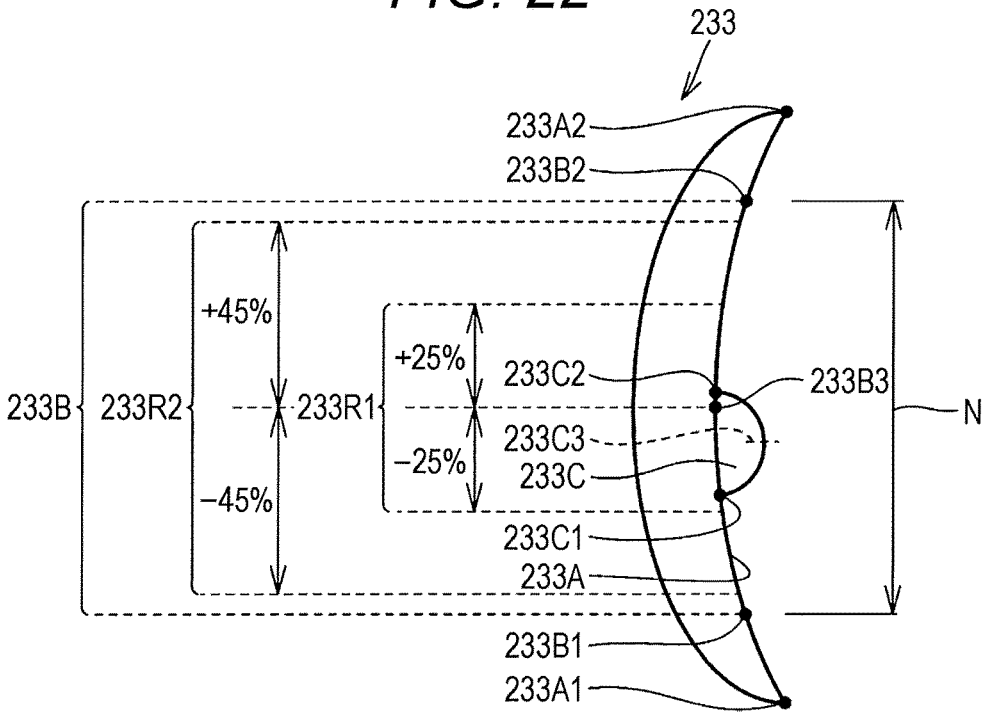
FIG. 22 is a diagram that illustrates a nip forming member included in a fixing device according to an eighth embodiment.

FIG. 22 is a diagram that illustrates a nip forming member 233 included in a fixing device according to the eighth embodiment. In this nip forming member 233, an opposing face 233A has the shape of a curved face curving in an arc shape toward the side of a support member 235 not illustrated in the drawing. The nip forming member 233 and the opposing face 233A may be configured to have such shapes.

[Ninth Embodiment]

Figure 23:
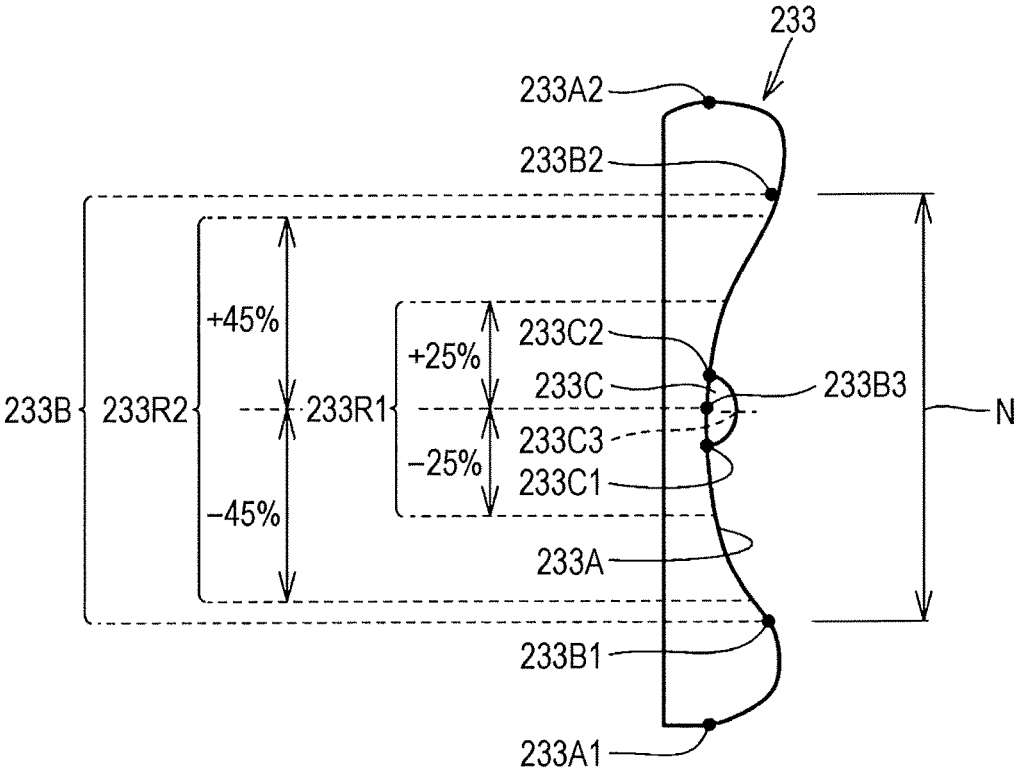
FIG. 23 is a diagram that illustrates a nip forming member included in a fixing device according to a ninth embodiment.

FIG. 23 is a diagram that illustrates a nip forming member 233 included in a fixing device according to the ninth embodiment. In the nip forming member 233 illustrated in FIG. 22, an upstream end portion 233A1 and a downstream end portion 233A2 of an opposing face 233A have angular surface shapes. In the nip forming member 233 illustrated in FIG. 23, the upstream end portion 233A1 and the downstream end portion 233 A2 of the opposing face 233A have gently curved surface shapes. The nip forming member 233 and the opposing face 233A may be configured to have such shapes.

The disclosure described above can be used for an image forming apparatus using an electrophotographic system used in a copying machine, a printer, a facsimile, or the like and fixing devices thereof.

In the fixing devices according to the second to ninth embodiments described above, the first convex part is disposed at a position other than the positions of the downstream end portion and the upstream end portion of the nip forming range in the circumferential direction, and, according to the presence of the first convex part, the contact pressure of a part in the circumferential direction inside the fixing nip is locally increased. By forming such a pressure distribution inside the fixing nip, the influence of the lowering of the fixing temperature can be decreased, and furthermore, the power consumption of the fixing device can be decreased.

In addition, the sliding member illustrated in the first embodiment described above and each of the convex parts illustrated in the second to ninth embodiments may be included in a same fixing device.

Although embodiments and experimental examples of the present invention have been described and illustrated in detail, it is clearly understood that the same is by way of illustration and example only and not limitation, the scope of the present invention should be interpreted by terms of the appended claims. The scope of the present invention is intended to include all the changes within the meaning and the scope equivalent to those of the claims.

What is claimed is:

1. A fixing device comprising:

a fixing belt of an endless shape that is wound to pass over a heating-side member and a nip forming member; and a pressing roller that is driven to rotate in a state of being brought into tight contact with the nip forming member through the fixing belt, wherein a nip portion at which the fixing belt and the pressing roller are brought into tight contact with each other by causing the pressing roller to be in tight contact with the fixing belt and driving the pressing roller to rotate, the nip portion being configured to fix a toner image to a recording medium at the nip portion, a guide member guiding the fixing belt to a space between the nip forming member and the heating-side member is disposed to be separate from the nip forming member, the guide member is disposed only at a position disposed on a further moving-direction downstream side of the fixing belt than the nip forming member, and the heating-side member is disposed at a position disposed on a further moving-direction upstream side of the fixing belt than the nip forming member, a lubricant holding part that is in contact with an inner circumferential surface of the fixing belt is disposed in the guide member disposed at a position disposed on a further moving-direction downstream side of the fixing belt than the nip forming member, the lubricant holding part being configured to coat the inner circumferential surface of the fixing belt with a lubricant, the lubricant holding part is disposed to protrude from the guide member toward the fixing belt, and a sliding member is disposed at least in a contact portion between the nip forming member and the fixing belt.

2. The fixing device according to claim 1, wherein at least corners of the nip forming member and the guide member facing each other are rounded.

3. The fixing device according to claim 1, wherein a curvature of the fixing belt at an end of the nip forming member away from the guide member is larger than on the guide member side.

4. The fixing device according to claim 1, wherein the sliding member is attached so as to be wound around the nip forming member.

5. The fixing device according to claim 1, wherein the lubricant is fluorine-based grease.

6. The fixing device according to claim 1, wherein unevenness is formed on a face of the sliding member that is disposed on a side in contact with the fixing belt, and a lubricant is held in this uneven portion.

7. The fixing device according to claim 1, wherein the nip forming member is in contact with the fixing belt in a state being fixed to a fixing member formed in a groove shape, and the fixing belt is guided from the heating-side member to the nip forming member without being in contact with the fixing member.

8. An image forming apparatus comprising a fixing device that fixes a toner image formed on a recording medium to the recording medium, wherein the fixing device includes: a fixing belt of an endless shape that is wound to pass over a heating-side member and a nip forming member; and a pressing roller that is driven to rotate in a state of being brought into tight contact with the nip forming member through the fixing belt, a nip portion at which the fixing belt and the pressing roller are brought into tight contact with each other by causing the pressing roller to be in tight contact with the fixing belt and driving the pressing roller to rotate, the nip portion being configured to fix a toner image to a recording medium at the nip portion, a guide member guiding the fixing belt to a space between the nip forming member and the heating-side member is disposed to be separate from the nip forming member, the guide member is disposed only at a position disposed on a further moving-direction downstream side of the fixing belt than the nip forming member, and the heating-side member is disposed at a position disposed on a further moving-direction upstream side of the fixing belt than the nip forming member, a lubricant holding part that is in contact with an inner circumferential surface of the fixing belt is disposed in the guide member disposed at a position disposed on a further moving-direction downstream side of the fixing belt than the nip forming member, the lubricant holding part being configured to coat the inner circumferential surface of the fixing belt with a lubricant, the lubricant holding part is disposed to protrude from the guide member toward the fixing belt, and a sliding member is disposed at least in a contact portion between the nip forming member and the fixing belt.

* * * * *